US006786717B2

(12) United States Patent
Shimazu et al.

(10) Patent No.: US 6,786,717 B2
(45) **Date of Patent: *Sep. 7, 2004**

(54) COMBUSTION APPARATUS

(75) Inventors: Masahiko Shimazu, Kobe (JP); Yasutaka Kuriyama, Kobe (JP); Takao Morigaki, Kobe (JP); Takashi Hasegawa, Kobe (JP); Hidenori Hata, Kobe (JP); Masaaki Matsuda, Kobe (JP); Shingo Kimura, Kobe (JP); Masahiro Iguchi, Kobe (JP); Takashi Akiyama, Kobe (JP); Yasuhiko Sato, Kobe (JP); Koji Shimomura, Kobe (JP); Toshikazu Miki, Kobe (JP); Shuji Kameyama, Kobe (JP); Keiichi Miura, Kobe (JP)

(73) Assignee: Noritz Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/348,058

(22) Filed: Jan. 21, 2003

(65) Prior Publication Data

US 2003/0148241 A1 Aug. 7, 2003

(30) Foreign Application Priority Data

| | | |
|---|---|---|
| Jan. 24, 2002 | (JP) | 2002-15199 |
| Feb. 12, 2002 | (JP) | 2002-33431 |
| Feb. 26, 2002 | (JP) | 2002-50131 |
| Mar. 14, 2002 | (JP) | 2002-70983 |
| Mar. 14, 2002 | (JP) | 2002-71096 |
| Mar. 14, 2002 | (JP) | 2002-71100 |
| Mar. 14, 2002 | (JP) | 2002-71101 |

(51) Int. Cl.[7] ..... F23D 14/62; F23Q 9/00

(52) U.S. Cl. ..... 431/354; 431/278; 431/285; 431/328; 126/92 R

(58) Field of Search ..... 431/285, 278, 431/354, 328, 12, 10, 275, 346; 126/92 R, 92 AC, 92 C, 85 R, 91 R

(56) References Cited

U.S. PATENT DOCUMENTS

| | | | | |
|---|---|---|---|---|
| 5,073,106 A | * | 12/1991 | Toyonaga et al. | 431/285 |
| 5,318,438 A | * | 6/1994 | Sugahara et al. | 431/285 |
| 2003/0143507 A1 | * | 7/2003 | Kuriyama et al. | 431/354 |

* cited by examiner

*Primary Examiner*—James C. Yeung
(74) *Attorney, Agent, or Firm*—Wood, Phillips, Katz, Clark & Mortimer

(57) ABSTRACT

A combustion apparatus (1) is generally composed of a principal part (5), a supplementary part (6) and a burner port assembly (3). Four metal plates (7,8,10,11) constituting the principal and supplementary parts (5,6) are pressed to have in them several protuberances and recesses. These metal plates are laid one on another to form in them some hollow spaces and sealed regions. These hollow spaces communicate with each other to form a thin gas passage (22) together with a thick gas passage (73) in this combustion apparatus (1) in such a manner that its condition of thick and thin fuel combustion is rendered more stable.

22 Claims, 34 Drawing Sheets

COMBUSTION APPARATUS

BACKGROUND OF THE INVENTION

1. Field of the Invention

The present invention relates to a combustion apparatus, and more particularly relates to a combustion apparatus adapted for use with a hot-water supply system, a boiler or the like.

2. Related Art

The "thick and thin fuel combustion" method known in the art is designed to burn a fuel gas in its thin state. At least one main flame formed by burning a thin gas and at least one auxiliary flame formed by burning a thick gas will be jetted in juxtaposition to each other in this prior art system. In detail, such a thin gas for forming the main flame is composed a volume of the gas premixed with an amount of air whose volume is about 1.6 times as much as the theoretical amount of air for said gas. A thick gas for forming the auxiliary flame contains a lesser amount of air.

In the thick and thin fuel combustion method, the fuel gas is burned with such an excess of air so that flame temperature is kept relatively lower to produce a less amount of nitrogen oxides. Thus, some types of current house-held water heater are constructed using such burners of the thick and thin fuel combustion system.

Examples of thick and thin fuel combustion apparatuses widely used heretofore are disclosed in the Japanese Patent Laying-Open Gazettes No. 10-238719 and No. 10-47614.

In the apparatus shown in the Gazette No. 10-238719, two fuel-air mixtures of different concentrations are prepared outside a burner body and fed thereto through respective burner ports. This system requires an external gas concentration regulator, which will render the apparatus more complicated in structure. One of the gas-air mixtures will be jetted at a very low rate through one of the burner ports whose opening area is so small that it is difficult to manufacture the apparatus and to precisely regulate the rate of jetted fuel-air mixtures.

In another thick and thin fuel combustion apparatus shown in the Gazette No. 10-47614, air is mixed internally thereof with a fuel gas fed through a fuel nozzle. This apparatus that does not need any external regulator for controlling the concentration of fuel-air mixture will be made simpler in structure.

However, these prior art combustion apparatuses have their principal parts manufactured each by combining metal plates one with another, which have been pressed or otherwise processed to have corrugations or the like. The pressing of metal plates can not ensure a satisfactory preciseness in dimension of said parts, often failing to provide an airtight mutual consolidation of their lateral sides. Consequently, a considerable quantity of gas mixture flowing in between two metal plates is likely to leak sideways through crevices present between the metal plates forming a fuel feed passage. In such an event, concentration and jet rate of fuel gas would suffer from fluctuation, resulting in an unstable combustion thereof.

SUMMARY OF THE INVENTION

An object of the present invention is therefore to provide an improved combustion apparatus that will stabilize combustion of a fuel gas.

In order to achieve this object, the present invention has made the following improvements.

From a first aspect, the present invention provides a combustion apparatus that comprises at least one main burner port for jetting and burning a thin fuel gas mixture, and at least one auxiliary burner port for jetting and burning a thick fuel gas mixture. This apparatus further comprises an air intake for introduction of air or the thin gas mixture, and a fuel intake for introduction of air and the thick gas mixture, in addition to a thin gas passage and a thick gas passage. The air intake communicates with the thin gas passage for supplying the main burner port with the gas, and the fuel intake communicates with the thick gas passage for supplying the auxiliary burner port with the gas. Characteristically in the apparatus of the invention, the thick gas passage surrounds in part a portion of the thin gas passage, and the portion of this passage has at least one supplementary gas openings formed therein. A controlled amount of the thick gas mixture flowing through the thick gas passage will enter the thin gas passage through the said supplementary gas ope nings.

The main burner port cooperates with the auxiliary burner port that jets high-concentration gas rather than the gas jetted from the main burner port. Thus, there will be established a condition for thick and thin fuel combustion such that a flame formed out of the main flame is stabilized by another flame formed out of the auxiliary burner port.

As noted above, the thick gas passage in the present invention surrounds a portion of the thin gas passage, and the portion of this passage has the supplementary gas opening formed therein. By virtue of this structure, a controlled amount of the thick gas mixture will enter the thin gas passage through which a highly thin gas mixture, or almost the air itself, is flowing. The fraction of fuel gas mixture will be stirred within the thin gas mixture or air so as to spread uniformly through-out it, spontaneously, smoothly and instantly when it flows into the thin gas passage. Thus, the gas mixture being jetted out from the main burner port will be homogenized in concentration of gas, thereby stabilizing the main flame. Incomplete combustion can now be almost avoided when starting operation of this apparatus, thus diminishing the amount of ecologically harmful exhaust gas.

From a further aspect, and also in order to achieve the object mentioned above, the present invention provides a combustion apparatus that comprises at least one main burner port for jetting and burning a thin fuel gas mixture, and at least one auxiliary burner port for jetting and burning a thick fuel gas mixture. This apparatus further comprises an air intake for introduction of air or the thin gas mixture, and a fuel intake for introduction of air and the thick gas mixture, in addition to a thin gas passage and a thick gas passage. The thin gas passage for supplying the main burner port with the gas communicates the air intake with the main burner port, and the thick gas passage for supplying the auxiliary burner port with the gas communicates the fuel intake with the auxiliary burner port. Characteristically in the apparatus of the invention, it comprises a blending station for intermixing the air with the thick gas mixture delivered from the fuel intake. Further, the thick gas passage has an enlarged or expanded section and a constricted section, with the former section directly continuing to the auxiliary burner port so as to supply it with the thick gas mixture. The constricted section of the thick gas passage intervenes between the blending station and the enlarged or expanded section. Thus, a part of the gaseous fuel flows from the blending station into the thin gas passage in order to form the thin gas mixture blown out through the main burner port. The remainder of the gaseous fuel will pass through the blending station and advance through the constricted section so as to remain as the thick gas mixture until blown out of auxiliary burner port.

Also in this apparatus provided herein from the further aspect, the main burner port cooperates with the auxiliary burner port that jets the fuel-air mixture richer in the fuel than the gas jetted from the main burner port. Thus, here is also established a condition for thick and thin fuel combustion such that a flame formed out of the main flame is stabilized by another flame formed out of the auxiliary burner port.

The thin and thick gas passages formed in the apparatus will feed respective gas mixtures to the respective burner ports. The gaseous fuel having entered the apparatus through the fuel intake is then mixed with the air within the blending station, before diverged into the thin and thick gas passages.

The remainder of air-fuel mixture will be agitated well when it passes through the constricted section of a reduced cross-sectional area, before advancing into the enlarged section of the thick gas passage. The gas mixture being blown from the auxiliary burner port will thus be of a homogenized concentration of gas and consequently generate a stable flame so long as the apparatus operates.

From a still further aspect, the present invention provides a combustion apparatus that comprises at least one main burner port for jetting and burning a thin fuel gas mixture, and at least one auxiliary burner port for jetting and burning a thick fuel gas mixture. This apparatus further comprises an air intake for introduction of air or the thin gas mixture, and a fuel intake for introduction of air and the thick gas mixture, in addition to a thin gas passage and a thick gas passage. The thin gas passage for supplying the main burner port with the gas communicates the air intake with the main burner port, and the thick gas passage for supplying the auxiliary burner port with the gas communicates the fuel intake with the auxiliary burner port. Characteristically, this apparatus comprises a blending station such that its cross-sectional flow area gradually decreases towards a downstream end of said station in order to intermix the air with the thick gas mixture delivered from the fuel intake. Further, the apparatus comprises a branching station constructed such that a part of the thick gas mixture will flow from this station through at least one supplementary gas opening and then into the thin gas passage in order to form the thin gas mixture to be blown out through the main burner port. The remainder of the gaseous fuel will pass through the blending station and advance through the constricted section so as to remain as the thick gas mixture until blown out of auxiliary burner port.

It is to be noted here that in some of the prior art apparatuses air will be blended with a gaseous fuel that is introduced into the apparatus through a fuel inlet or nozzle. The stream of such a fuel gas will cause a spontaneous but insufficient mixing thereof with air. There is a possibility that an uneven mixing of fuel with air will result from any error or disorder in location and/or angle of the fuel inlet.

The blending station in the present invention gradually decreases its cross-sectional area from the fuel intake until reaching the downstream end of the blending section. By virtue of this structure of said blending section, the flow speed of the mixture of a fresh air and a gaseous fuel will gradually increase to thereby bring about a uniform blending of them, so that the mixture flowing out of the downstream end continuously produces a stable flame.

Even if the fuel nozzle or inlet would be somewhat offset relative to the fuel intake, whether in four directions or in an angular direction, the fresh air will surely be intermixed homogeneously with the gaseous fuel within the apparatus of the invention. The thick gas mixture composed of the gaseous fuel and the fresh air well intermixed therewith is diverged into the thick and thin gas passages, so that the ratio in gas concentration of the thick gas mixture to the thin one is kept stable. Thus, the main and auxiliary flames will never fluctuate nor vary in the course of time as to their combustion state.

It may be possible to incorporate into the blending station a proper means for accelerating the mixing of fuel and air. The accelerating means may be of any desired shape insofar as it can stir the fuel in the air while the mixture thereof is flowing to the downstream end. Either a portion of the constituent part of the blending station, or a discrete member, may be employed as such an accelerating means.

In typical examples of the apparatuses summarized above, a central row of the main burner ports is sandwiched between two side rows of the auxiliary burner ports so that main flames will be kept stable. However, since the amount of the gas jetted from two side rows of auxiliary burner ports become uneven, there is a possibility that two side rows of auxiliary flames become somewhat unbalanced.

The branching station included in the apparatus just summarized above may be intended to play a very important role to avoid such an unbalance. The branching station disposed at a middle region of the constricted section will serve to divide the fuel gas mixture, in a well-balanced manner, into two branches of thick gas passage. One of these branches extends along one side of the thin gas passage, with the other branch extending along the other side of said thin gas passage. Thus, a part of the fuel gas mixture leaving the blending station will flow into the thin gas passage so as to form a thin gas mixture to be jetted from the main burner ports. On the other hand, the remainder of said fuel gas mixture also leaving the blending section will rush into the constricted section, before being diverged into two streams respectively flowing through two branches of thick gas passage, wherein these branches are disposed each beside the central thin gas passage. Thus, the two streams of thick gas mixture will be jetted in harmony from the respective rows of auxiliary burner ports.

In more detail, metal plates may be pressed each to be of a predetermined shape before overlaid one on another to form the passages and the like mentioned above. The predetermined shape will include grooves and ribs, and dimensional accuracy thereof being much higher at their middle regions than at their end regions. Thus, the constricted section formed intermediate between opposite ends of each gas passage will be made most precise in dimension.

By virtue of this feature, the branching station disposed at a middle region of the constricted section can divide the gas mixture flow into two branch streams almost of the same flow rate, whereby a good balance will be ensured between the auxiliary flames.

Each combustion apparatus summarized above may be constructed using four generally parallel walls, that is two central or inner walls and two outer walls sandwiching them. In this case, the two inner walls will define between them the thin gas passage leading to the main burner ports. On the other hand, one of the inner walls and one of the outer walls will define one of branches of the thick gas passage leading to the auxiliary burner ports. Similarly, the other inner wall facing the other outer wall will define between them the other branch also leading to the other auxiliary burner ports.

Such a structural principle will not only simplify the structure and manufacture of combustion apparatus, but also render it smaller in size.

Characteristically, the blending station may be formed by reducing the cross-sectional area of thick gas passage, gradually towards its downstream end from the fuel intake.

In other words, the blending station in the present invention may be tapered off towards its downstream end. Thus, the flow speed of the mixture of a fresh air and a gaseous fuel will gradually increase to facilitate the blending of them, so that a uniform mixture flowing out of the downstream end maintains a constant concentration.

Even if the fuel nozzle or inlet would be somewhat offset relative to the fuel intake, whether in four directions or in an angular direction, the fresh air will surely be intermixed homogeneously with the gaseous fuel within the apparatus of the invention. The thick gas mixture composed of the gaseous fuel and the fresh air well intermixed therewith is diverged into the thick and thin gas passages. Ratio in gas concentration of the thick gas mixture to the thin one is now kept stable, so that the main and auxiliary flames will never fluctuate nor vary in the course of time as to their combustion state.

A plurality of the described combustion apparatuses may be combined one with another to form a cluster or group of them. Also in this case, any error in positional and/or angular arrangement of each fuel gas feed nozzle will not cause any instability in concentration of the thick and thin gas mixtures. Any uneven combustion will not take place in the group of said apparatuses as a whole.

It may be possible to add to the blending station a proper means for accelerating the mixing of fuel and air. The accelerating means may be of any desired shape insofar as it can stir the fuel in the air while the mixture thereof is flowing to the downstream end. Either a portion of the constituent part of the blending station, or a discrete member, may be employed as such an accelerating means.

Alternatively, the blending station may characteristically be formed by at first reducing the cross-sectional area of thick gas passage gradually a given distance from the fuel intake, and by increasing again said cross-sectional area downstreamly of the given distance and towards the distal end of said gas passage.

Due to such a tapered-off-and-clavate shape of the blending station, the mixture of fuel gas taken in together with fresh air through the fuel intake will be accelerated in the taper-off region to be blended uniformly while lowering its pressure. This mixture will then be decelerated in the clavate region to restore its pressure before diverged into the thick and thin gas passages.

Also characteristically, the branching station for directing the part of thick gas mixture to the thin gas passage may be disposed downstreamly of a neck where the blending station has a minimum cross-sectional area.

Due to such a position of the branching station in and relative to the blending station, a well-mixed and homogeneous gas mixture will be delivered from the latter station to the former station.

This feature will stabilize the concentration ratio of the gas mixture flowing through the thick gas passage to the other gas mixture flowing through the thin gas passage, thus avoiding any unstable combustion of the main and auxiliary flames.

It may be possible to incorporate into such a tapered-off blending station a proper means for accelerating the mixing of fuel and air, for the sake of facilitating the mixing of the gaseous fuel with the fresh air, both being sucked in through the fuel intake.

Well-mixed gas mixtures thus produced owing to such a mixing-acceleration means will be supplied to both the thick and thin gas passages, thereby avoiding uneven combustion that would otherwise be caused by any uneven and insufficient mixing of the fuel gas with the fresh air.

The accelerating means may be of any desired shape insofar as it can stir the fuel in the air while the mixture thereof is flowing to the downstream end. Either portions of some constituent parts of the blending station, or discrete members, may be employed as such an accelerating means.

For example, either bent or curved zones or constricted sections may be formed in the thick and/or thin gas passages in order to assist the components of each gas mixture to intermix with each other quicker and thoroughly. However, air or gaseous fuel will produce noise or a whistling sound when they run past those bent zones or constricted sections.

The present inventors have tested a variety of countermeasures for preventing such a noise or sound, and found that certain convex or concave portions formed in the wall of each gas passage would be highly effective. In addition, such convex or concave portions have proved useful to make more uniform in pressure and more homogeneous in composition each successive mass of the gas mixture flowing by them.

Therefore, the combustion apparatus provided herein may be designed such that the inner wall surface of each thin and/or thick gas passages has partially or wholly certain convex or concave portions.

Preferably, these convex or concave portions are formed in the passage wall disposed adjacent to a deflecting or bent area. The air and fuel gas will flow smoothly along such a wall while generating minute or small vortices, but diminishing large vortices that would cause the noise or whistling sound. Each flow of the thick or thin gas mixture will not suffer from any uneven mixing but be rendered uniform in pressure, while forming a substantially laminar flow directed to the respective downstream regions.

According to experiments which the present inventors have conducted, the most effective anti-noise shapes of those convex or concave portions are round columns, hemispheres, triangular columns, cones, triangular pyramids, burred portions or the like that are easy to form.

Characteristically, the thick gas passage may comprise an enlarged or expanded section communicating with the auxiliary burner ports, as well as a constricted section opened towards the enlarged section so as to feed thereto the thick gas mixture.

The thick gas mixture will be agitated well when it passes through the constricted section of a reduced cross-sectional area, before advancing into the enlarged section of the thick gas passage. The gas mixture being blown from the auxiliary burner ports will thus be of a homogenized concentration of gas and consequently generate stable flames so long as the apparatus operates.

In detail, the enlarged or expanded section may be spread in a plane and have an end opened outwards, so as to comprise an elongated region having a cross section extending in parallel with another plane that includes the open ends of burner ports, as well as a constricted section. An opening of the constricted section communicates with the interior of the enlarged section, and is offset from the center of an imaginary line along which the enlarged section extends. However, the opening of said constricted section, and/or the direction of jetting the thick gas mixture therefrom, may face the center of said imaginary line.

Although the constricted section's opening is positioned offset relative to the center of the enlarged section, the thick gas mixture jetted from such an opening will not be delivered superfluously to any limited region of said enlarged section. Because the direction of said opening and/or the jetting direction face the center of enlarged section, the gas mixture will rush in this direction to spread uniform throughout the enlarged section. All portions of each auxiliary burner port will thus receive portions or tributaries of the gas mixture flow at the same rate and with a reduced time lag between them, before respectively jetting and burning it. All the gas flow tributaries will be ignited readily in unison to form stable unit flames so as to provide an auxiliary flame all over the full length of each auxiliary burner port, thereby improving inflammability of fuel gas mixture as a whole to be simultaneously burnt at the auxiliary burner ports and stability of main flames assisted with auxiliary flames. The quantity of raw gas not burnt but wasted when igniting this combustion apparatus to start its operation will now be reduced to a noticeable degree.

Ignition can be done at any region of the elongated auxiliary burner port. If the gas mixture tributary effluent from the innermost region most remote from the air intake is ignited at first, then a unit flame thus produced is not likely to be fanned by the fresh air stream flowing in from the air intake. In this case, ignition of, flame propagation within and extinguishing of this combustion apparatus will be effected smoothly, thereby reducing waste of raw gas. The so-called pulsating combustion will also be avoided when a user operates the apparatus to change its fire condition.

A deflector or the like member may be disposed in the enlarged or expanded section so as to face the outlet opening of the constricted section, at a location 'extrapolated' therefrom.

The gas mixture blown from the constricted section at any given angle into the enlarged section will, in this case, collide with the deflector and be directed towards the center of elongated enlarged section of the thick gas passage. Such a deflector or the like member will facilitate distribution of the gas mixture within the enlarged section.

Also in this case, all the portions constituting each auxiliary burner port will thus receive portions or tributaries of the gas mixture flow at the same rate and with a reduced time lag between them, before respectively jetting and burning it. All the gas flow tributaries will be ignited readily in unison to form stable unit flames so as to provide an auxiliary flame all over the full length of each auxiliary burner port, thereby improving inflammability of fuel gas mixture as a whole to be simultaneously burnt at the auxiliary burner ports and stability of main flames assisted with auxiliary flames. The quantity of raw gas not burnt but wasted when igniting this combustion apparatus to start its operation will now be reduced to a noticeable degree. Further, uniform jet of the gas mixture from the full length of elongated and enlarged section will lower the level of operation noise of this apparatus.

The deflecting means may be of any proper shape, such as a flat plate, a bent plate, a tubular piece, a perforated plate and so on to be chosen in view of the deflected direction. The deflecting means may not necessarily be a single member but be a pair or group of two or more members.

In a case wherein shape and/or position of the constricted section can not be designed freely, but causing a problem in the structure of combustion apparatus, employment of the deflecting means will resolve such a problem. Even if the structure of said apparatus would undesirably delimit the direction of outlet opening of the constricted section jetting the fuel gas, the deflecting means will be useful to avoid any disadvantage resulting from such a structural condition.

It may also possible to construct a plurality of dams within the enlarged or expanded section communicating with the outlet opening of the constricted section. 'Inter-dam' canals each formed between and extending over the dams may preferably not be in alignment with the extrapolation of constricted section.

Such a misalignment of the inter-dam canals will inhibit the jet stream of gas mixture from directly entering any one or some of the canals from the constricted section. The jet stream will instead impinge at first on the nearest or proximal dam to be decelerated and deflected to flow along it while being distributed longitudinally of the elongated section. As a result, the gas mixture stream is divided into tributaries flowing through respective inter-dam canals so as to be blown out of auxiliary burner ports.

All the inter-dam canals receive, at a reduced time lag between them, the gas mixture tributaries at the same rate to be uniformly jetted out from the elongated auxiliary burner ports.

Each inter-dam canal may be of a smaller cross-sectional area as compared with the thick gas passage and each auxiliary burner port. Agitation of each tributary within such a canal will contribute to a better mixing of the mixture components.

Another apparatus similar to but somewhat different from that which has just been discussed above may be employed.

Thus, from a yet still further aspect, the present invention provides a combustion apparatus that comprises at least one main burner port for jetting and burning a thin fuel gas mixture, and at least one auxiliary burner port elongated or expanded for jetting and burning a thick fuel gas mixture. This apparatus further comprises a thick gas passage that is composed of an enlarged or expanded section of a larger cross-sectional area, and a constricted section of a smaller cross-sectional area and opened into the enlarged section so as to supply it with the gas mixture. Characteristically, this apparatus comprises a plurality of dams such that inter-dam canals formed each between the adjacent two dams are of different cross-sectional areas.

The inter-dam canals of larger cross-sectional areas and less resistant to the gas mixture flows are more receptive thereof than the other ones of smaller areas. Therefore, the one inter-dam canal standing as a target for the jet from the constricted section may preferably be of the smallest cross-sectional area. In this way, all the canals will receive the gas mixture tributaries substantially at the same rate and at a least possible difference in time lag between all the portions of each auxiliary burner port. All the gas flow tributaries will be ignited readily in unison to form stable unit flames so as to provide an auxiliary flame all over the full length of each auxiliary burner port. The quantity of raw gas not burnt but wasted when igniting this combustion apparatus to start its operation will now be reduced to a noticeable degree. Uniform jetting of the gas mixture from said auxiliary burner port does also reduce operation noise generated by this apparatus.

In a characteristic example of the combustion apparatus just discussed above, two or more plates are overlaid one on another such that convex or concave portions of these plates will form cavities. Other portions of the plates will be pressed together to provide airtight seals such that the cavities continue from and communicate with each other to form passages for air and fuel gas. Some plate portions that are of convex or concave shapes in the same direction will be pressed together to undergo plastic deformation so as to form interference fit engagements serving as some of the seals.

This technique is employed herein, because any simple doubling of convex or concave portions is difficult to provide an airtight seal between them. It is to be noted in this connection that such preliminarily pressed or bent convex or concave portions are not of strictly precise curvatures or radii thereof, inevitably leaving an interstice between them.

It is difficult to interpose forcibly any sealant or the stuffing material between them. If any sealant or the stuffing material is forcibly interposed between such preliminarily pressed convex or concave portions, then irregular deformation will be produced around them to change cross-sectional areas of the gas passages to an impermissible extent.

The interference fit engagements formed herein by the plastic deformation technique noted above resolve this problem, since they do not have any interstice or clearance between the plate portions convex or concave in the same direction and closely contacting one another. Gaps present between the plate portions are now airtightly divided into regions that respectively constitute the gas passages each sealed at any desired points.

Fuel gas mixtures flowing through such properly sealed passages will neither leak therefrom nor undesirably mingle with each other. Concentration and jet quantity of the fuel gas mixture are now kept uniform over the full length of each burner port, thereby affording a stabilized state of combustion.

DESCRIPTION OF THE PREFERRED EMBODIMENTS

Figure 1:
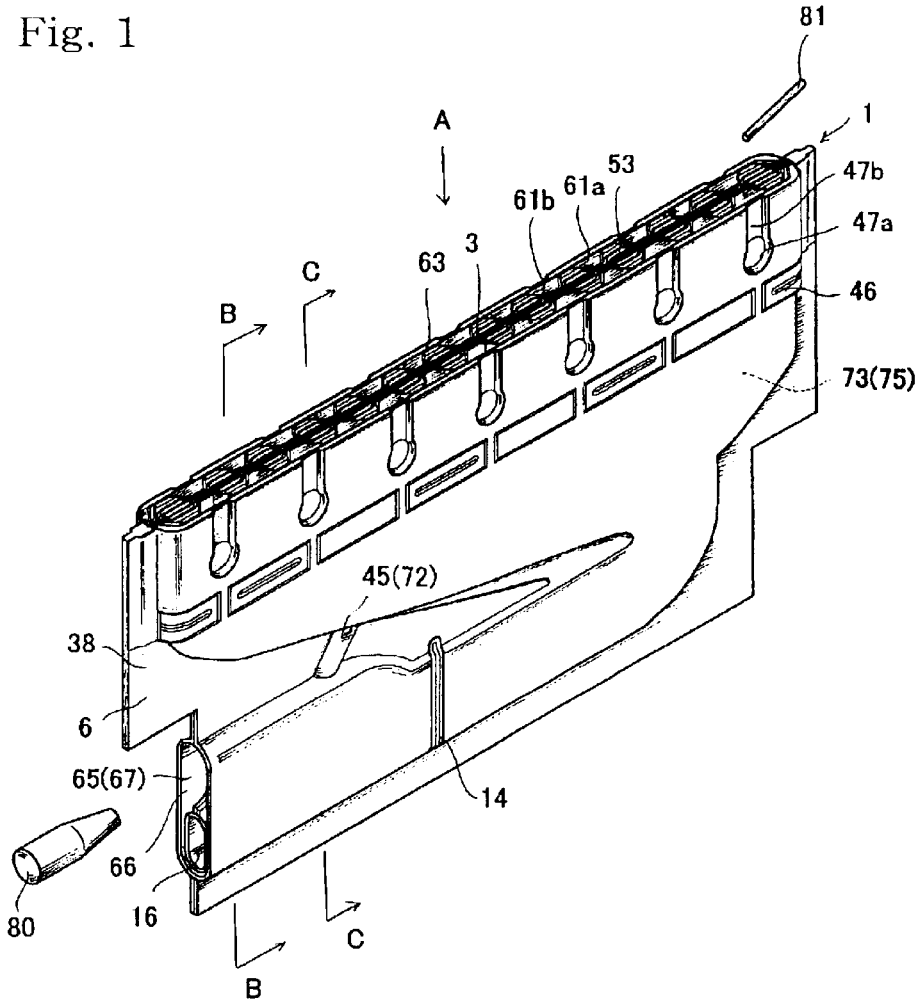
FIG. 1 is a perspective view of a combustion apparatus provided in an embodiment.

Now, some embodiments of the present invention will be described in detail referring to the drawings.

FIG. 1 illustrates a combustion apparatus provided in an embodiment, indicated generally at the reference numeral 1. This apparatus 1 is designed to perform the so-called thick and thin fuel combustion, wherein a thin fuel gas will be burnt generating main flames. A thick fuel gas is burnt generating auxiliary flames. Similarly to the prior art, a single apparatus 1 may be used alone or some apparatuses 1 may be arranged to for a row in a proper casing. The combustion apparatus 1 comprises a burner body 2 and a burner port assembly 3.

The burner body 2 consists of a principal part 5 and a supplementary part 6 covering opposite side faces of the principal part. The principal part 5 is composed of two metal plates 7 and 8, with the supplementary part 6 being likewise composed of two further metal plates 10 and 11. In other words, the burner body 2 is constructed by stacking the four plates 7, 8, 10 and 11 and side by side and consolidating them into an integral unit.

Figure 3:
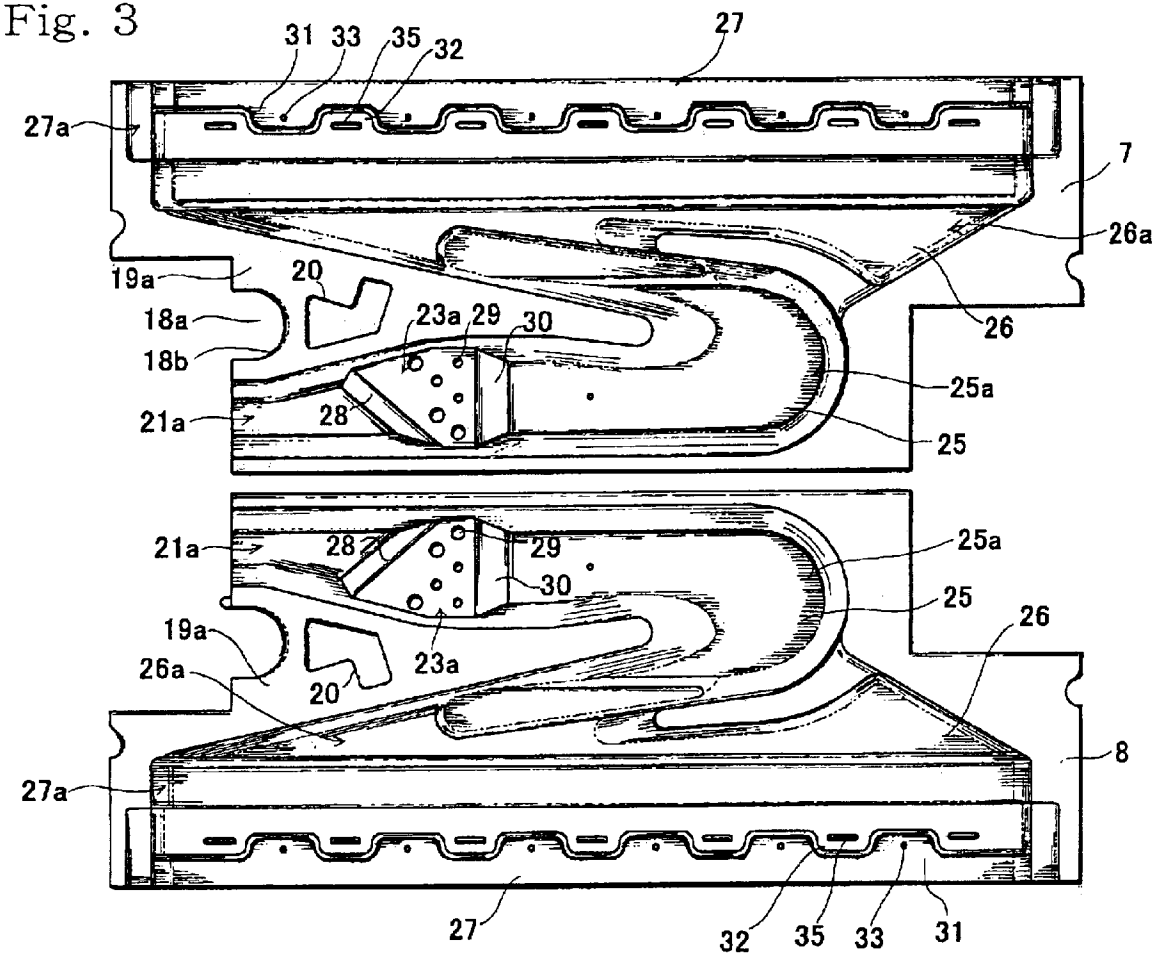
FIG. 3 is a front elevation of plates forming a main body of the combustion apparatus shown in FIG. 1.

FIG. 3 is a front elevation of the two metal plates forming the principal part 5. As shown there, its two constituent plates 7 and 8 are prepared each by pressing a flat metal plate to have bulged portions and depressed portions. The principal part 5 is composed of six pairs of fragments, and three pairs thereof are air intake fragments 21*a*, intermediate fragments 19*a* serving as tie walls 19 and venturi fragments 23*a*. The air intake fragments 21*a* serve to airtightly connect an air intake 16 (described below) to a venturi portion 23 formed of the venturi fragments 23*a*. The other three pairs are gas chamber fragments 25*a* forming a thin gas mixing chamber 25, communicating fragments 26*a* forming a communication channel 26, and burner port fragments 27*a* forming a burner port assembly holder 27. All the fragments in each metal plate integrally continue from one to another.

Figure 4:
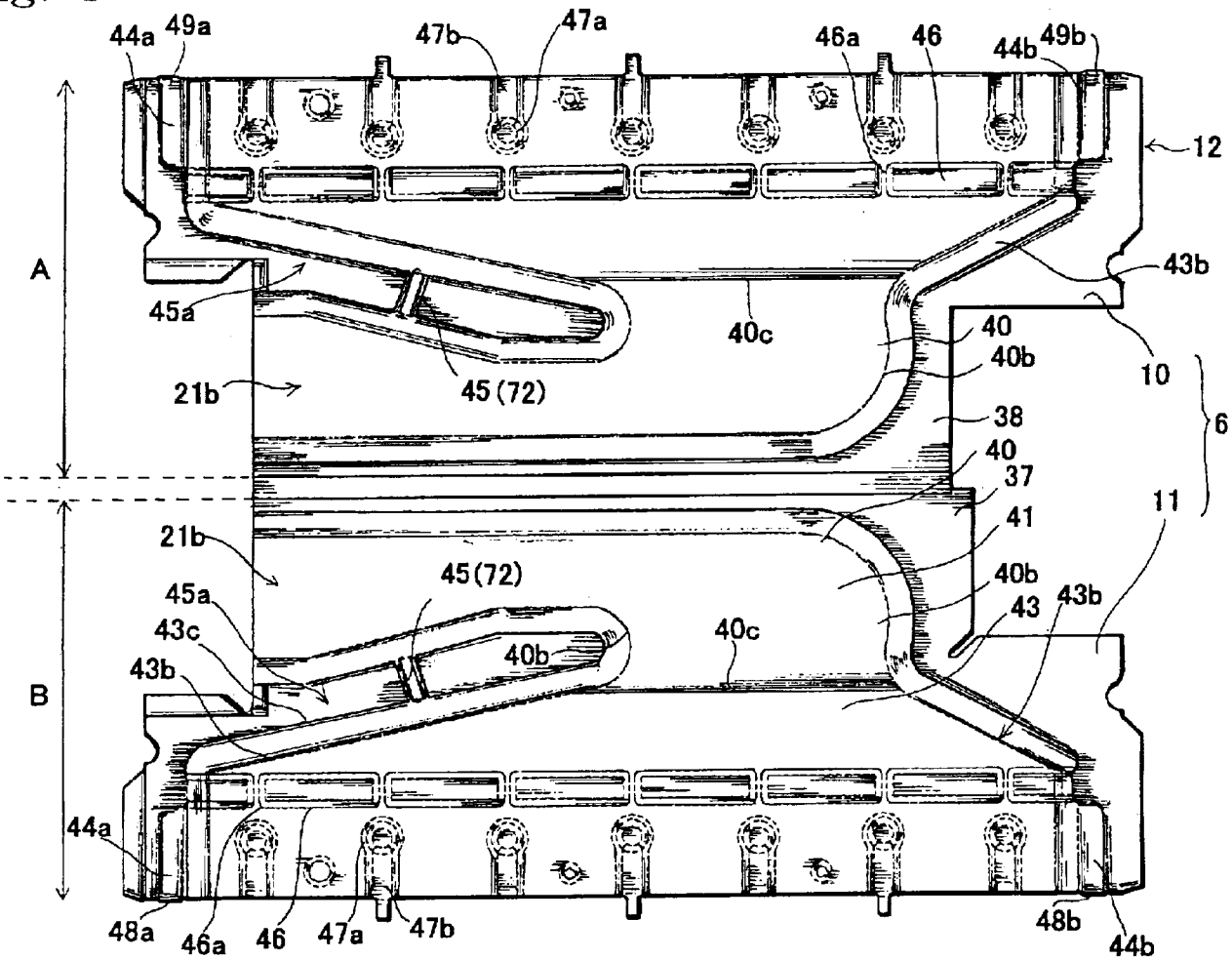
FIG. 4 is a front elevation of further plates forming a supplementary body of the apparatus shown in FIG. 1.

FIG. 4 is a front elevation of metal plates forming the supplementary part 6 of the combustion apparatus shown in FIG. 1. As seen in FIG. 4, the two flat metal plates constituting this part 6 and united with each other at their bottoms will be subjected to the pressing step of forming bulged and depressed regions in each plate 10 and 11. Two of the four pairs of fragments thus formed are intake fragments 21*b* extending from the air intake 16 (described later) to a recess 40, and recessed fragments 40*b* forming the recess 40. The other two pairs are gas passage fragments 43*b* forming a bulged passage 43 for a thick gas mixture, and contact fragments 45*a* to be tightly combined with intermediate tie walls 19 of the principal part 5.

Figure 5:
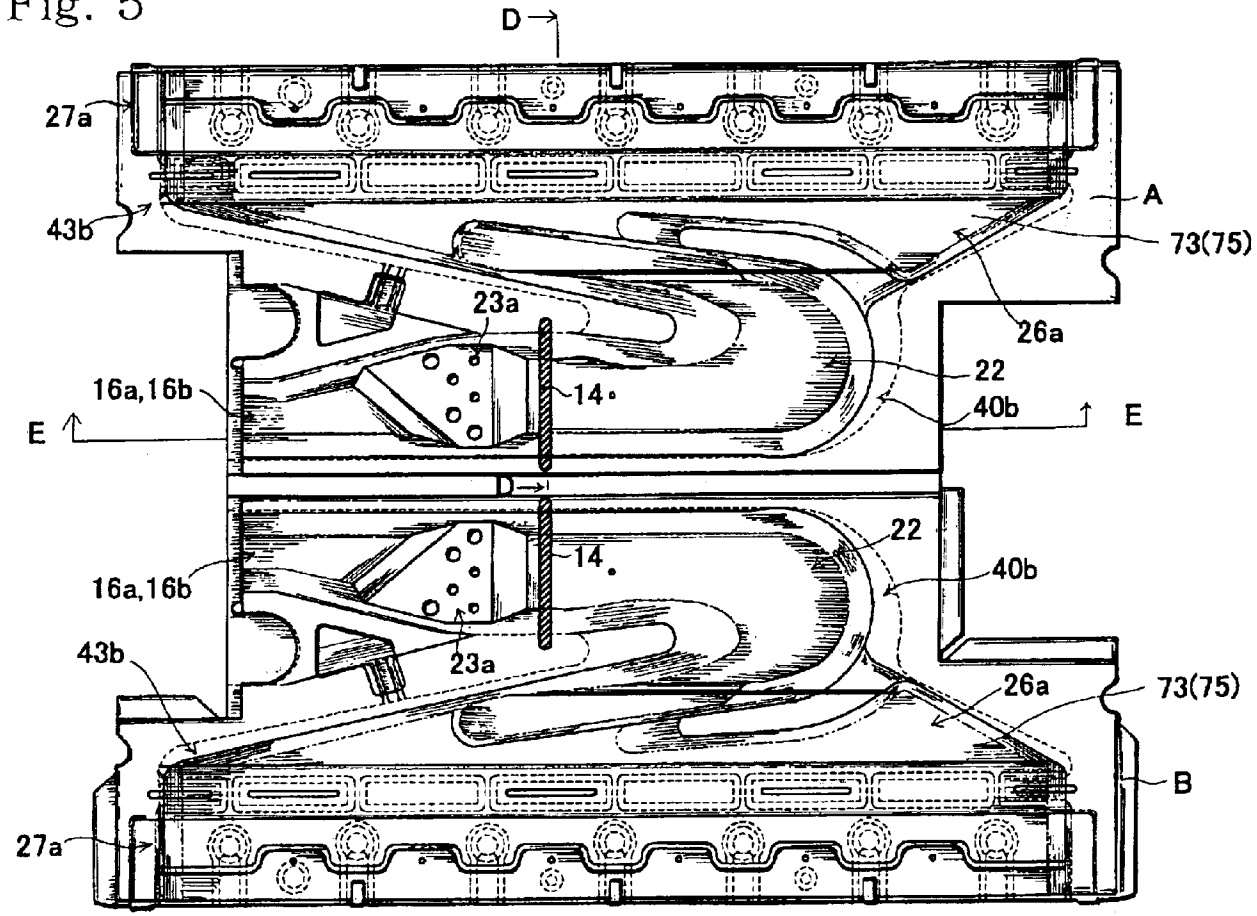
FIG. 5 showing a process of manufacturing the apparatus shown in FIG. 1 is a front elevation of the main body shown in FIG. 3 and overlaid on and caulked to the supplementary body shown in FIG. 4; a modification of the direct expansion type heat exchanger.

As seen in FIG. 5, the plates 7 and 8 of the principal part 5 will be laid on a half segment 'A' (viz., plate 10) and 'B' (viz., plate 11) of the integral metal plate 12, respectively, at the assembling step. In detail, the intake fragments 21*b* of the supplementary part 6 overlie the respective air intake fragments 21*a* of the principal part 5. The recessed fragments 40*b* of the supplementary part 6 cover both the gas chamber fragments 25*a* and venturi fragments 23*a* of principal part 5. The gas passage fragments 43*b* of supplementary part 6 are superposed on both the communicating fragments 26*a* and burner port fragments 27*a* of principal part 5.

The principal and supplementary parts 5 and 6 laid one on another in this way will then be spot welded to each other. In addition, these parts 5 and 6 are subjected the next step to be caulked in part at their portions respectively included in the gas chamber fragments 25*a* and recessed fragments 40*b*. As a result, interference fitting-engagement appearing between those portions will serve to firmly secure the parts one to another, while forming therein ribs 14 to jut outwards. Side edges of the constituent plates of the principal part 5 that are previously bent inward s to face one another will be fixed one on another, by the spot welding.

Structural details of the present combustion apparatus 1 will now be discussed, supposing that its constituent parts 5 and 6 have been combined in the manner as described above.

Figure 2:
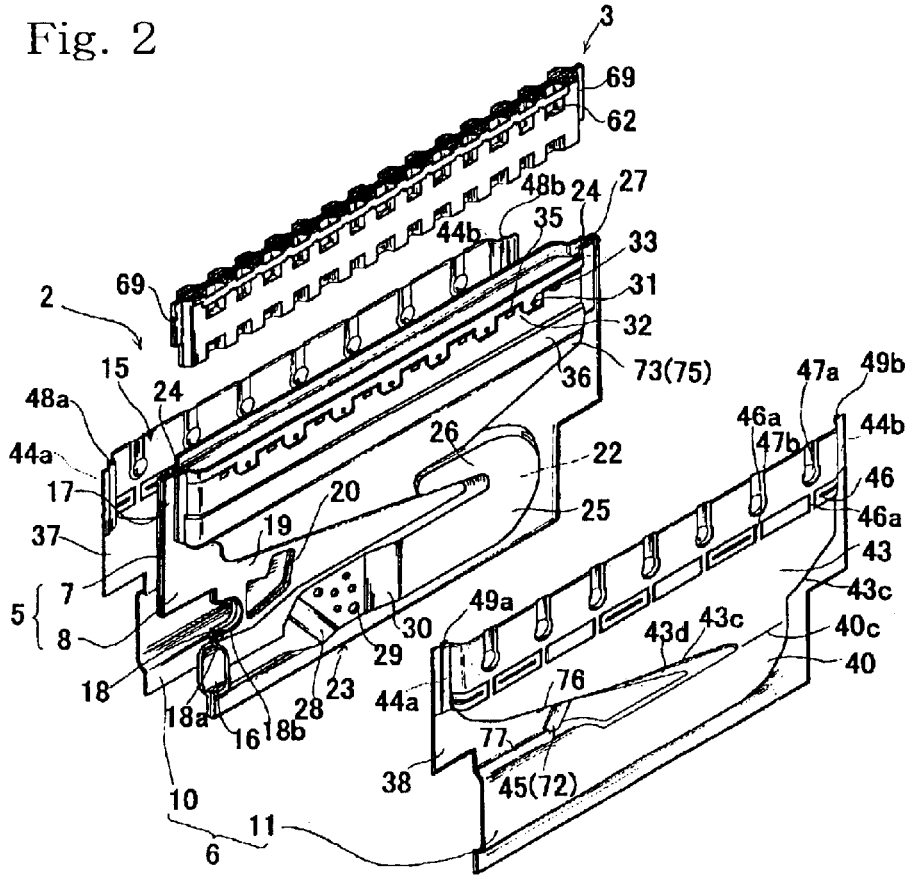
FIG. 2 is an exploded perspective view of the combustion apparatus shown in FIG. 1.

As seen in FIG. 2, the principal part 5 is generally of a plane configuration. Its air intake 16 and its top 15 (also serving as the top of apparatus 1) are opened to the outside. A flange 17 is formed in and along three sides except for the air intake 16 and the open top 15. A portion of the flange 17 is cut off to provide a generally semicircular cutout above the air intake 16, so as to provide a mixing-accelerator 18.

Figure 16:
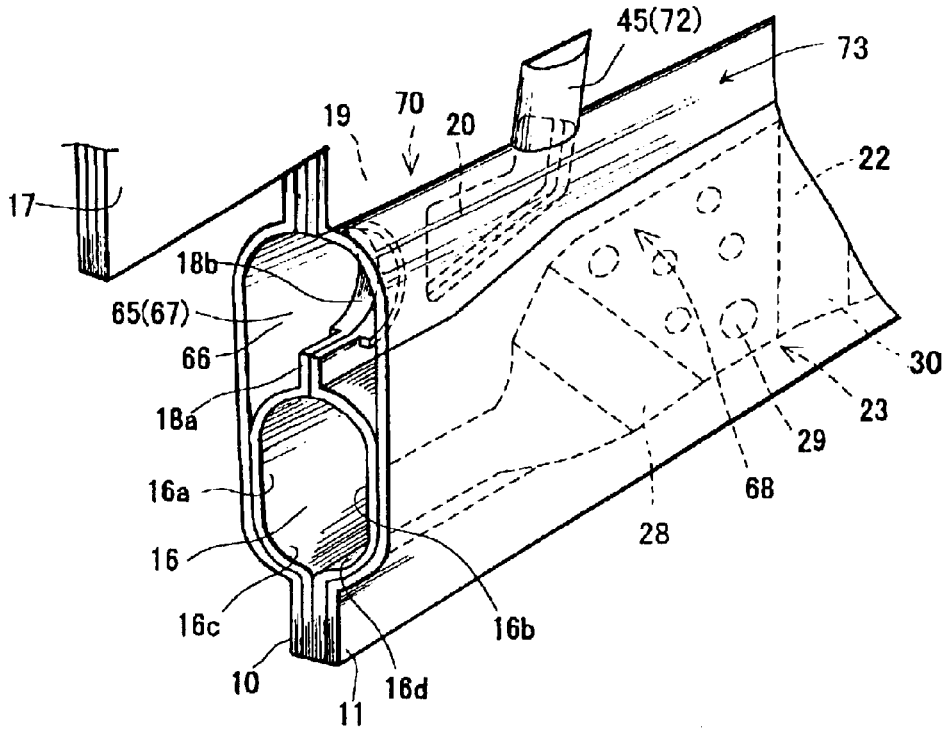
FIG. 16 is an enlarged fragmentary perspective view of the apparatus shown in FIG. 1.

As seen in FIGS. 2 and 16, the mixing-accelerator 18 is formed by severing at first a portion from the flange 17 to prepare a square cutout and further cutting off its inner edge to provide a semicircular cutout 18*a* continuing from the square cutout. The thus formed innermost arcuate edges will then be burred sideways away from each other to give transverse protrusions 18*b*.

A communication hole 20 is formed above the air intake 16 and downstreamly of the mixing-accelerator 18. This hole 20 is composed of a generally horizontal region extending towards the accelerator 18 and a generally upright but slightly slanted region. These regions merge with each other into a single opening, that is, the generally L-shaped communication hole 20 as shown in FIGS. 2 and 16. The horizontal region of communication hole has an upper border extending along the oblique edge of bulged passage 43 formed in the plates 10 and 11. The horizontal region has also a lower border extending along a slanted ceiling of the air intake 16. Thus, the communication hole's horizontal region increases its vertical width towards its upstream end facing the accelerator 18. On the other hand, the generally upright region of said hole 20 has its fore-to-aft width generally equal to the inner diameter of a thick gas passage 72 (detailed later), and has an up-ward length reaching the middle height of this passage 72. The communication hole 20 of such a configuration penetrates both the constituent plates 7 and 8 of the principal part 5 so as to render uniform the pressure of gas mixture flowing into this part. Further, this communication hole 20 serves also as a branching station for diverging into branch streams the fuel gas mixture fed in through a fuel intake 66. In detail, one of such branch streams advances into a thin gas passage 22, with the other stream flowing into a thick gas passage 73.

Portions of the constituent plates 10 and 11 of supplementary part 6 cover the communication hole 20 so as to form a blending station 70 as shown in FIG. 16. Portions of the tie walls 19 are disposed adjacent to the mixing accelerator 18 and communication hole 20.

As seen in FIG. 2, the thin gas passage 22 as a series of regions continuing one to another is defined between the two constituent plates 7 and 8 of principal part 5. Some portions of these plates closely contact one another, and the remainder portions are spaced one from another to form between them the thin gas passage 22.

As seen also in FIG. 2, the thin gas passage 22 generally consists of the venturi portion 23, the thin gas mixing chamber 25, the communication channel 26 and the burner port assembly holder 27. Thus, this passage 22 starts from the air intake 16 and then progresses through the said portion 23, chamber 25, channel 26 and holder 27, in this order.

The air intake 16 is an oval opening continuing inwards a distance to reach a tapered-off region 28 at the entrance of venturi portion 23, so as to sharply throttle herein the thin gas passage 22. Downstream end of the venturi portion 23 is defined as a flared region 30 to increase again the cross-sectional area of said gas passage 22.

As will be seen best in FIG. 16, the tapered-off region 28 is inclined to have its upper end that is disposed nearer the air intake 16 than its lower end is, whilst the flared region 30 stands almost upright. Therefore, the venturi portion 23 is generally of a reversed triangular shape in side elevation.

Such a reversed triangular shape of venturi portion 23 is employed for the following two reasons.

Firstly, even if an imaginary upright tapered-off region (28) are formed to define an imaginary square venturi portion (23) having supplementary gas openings (29) scattered all over it, any noticeable amount of thick gas mixture would not enter the thin gas passage through the openings (29) disposed at upstream and lower corner of such a square venturi portion (23).

Secondly, the combustion apparatus 1 of the embodiment has to accelerate therein the mixing of air with fuel gas, both sucked in through the fuel intake 66. Such a mixture of the air and fuel gas must be kept uniform in internal pressure throughout its passage. For these purposes, the blending station 70 should have its cross-sectional area reduced at first and then expanded again as it progresses downwards. The inclined tapered-off region 28 employed herein will meet this requirement because the cavity surrounding the venturi portion 23 gradually increases as the passage progresses inwards.

Height and cross-sectional area of the thin gas passage 22 in the region of venturi portion 23 gradually increase towards the downstream regions of this passage 22, until the area becomes constant at a given maximum height. The venturi fragments 23*a* of the constituent plates 7 and 8 defining the venturi 23 in this embodiment lie in parallel with each other.

A plurality of the supplementary gas openings 29 may be formed in each flat wall of the triangular venturi portion 23, in the combustion apparatus of the present embodiment shown in FIG. 16. As an example, six openings 29 arranged in a staggered pattern are of different diameters depending on their positions. The thin gas passage 22 has to receive the thick gas mixture essentially uniformly all over its cross section. Therefore, an optimal diameter is selected for each supplementary gas opening 29, taking into account different levels of negative pressure appearing at different heights, and also in view of different numbers of said openings aligned with respective stream lines of the gas mixture.

Instead of forming such a preferable staggered pattern, the supplementary gas openings 29 may alternatively be arranged along a horizontal line or lines, or along a vertical line or lines. Only one or a few openings 29 can be formed in the venturi, if so desired, although not recommended.

As shown in FIG. 2 the flared region 30 defining a downstream border of said venturi 23 will gradually increase the transverse width of thin gas passage 22, before it accurately changes its direction to define a large hairpin curve as the thin gas mixing chamber 25.

This mixing chamber 25 terminates at its downstream end located centrally of the principal part 5, and the gas passage 22 is narrowed again to continue to the communication channel 26. This channel 26 has a trans verse width or thickness of about a half of that of the thin gas mixing chamber 25, and forms a triangular space whose summit is the downstream end of said chamber 25.

The communication channel 26 connects the downstream end of the mixing chamber 25 to an upstream end of the burner port assembly holder 27. Horizontal distance between the air intake 16 and the downstream end of the channel 26 is about one third of the full length of the principal part 5.

Figure 15:
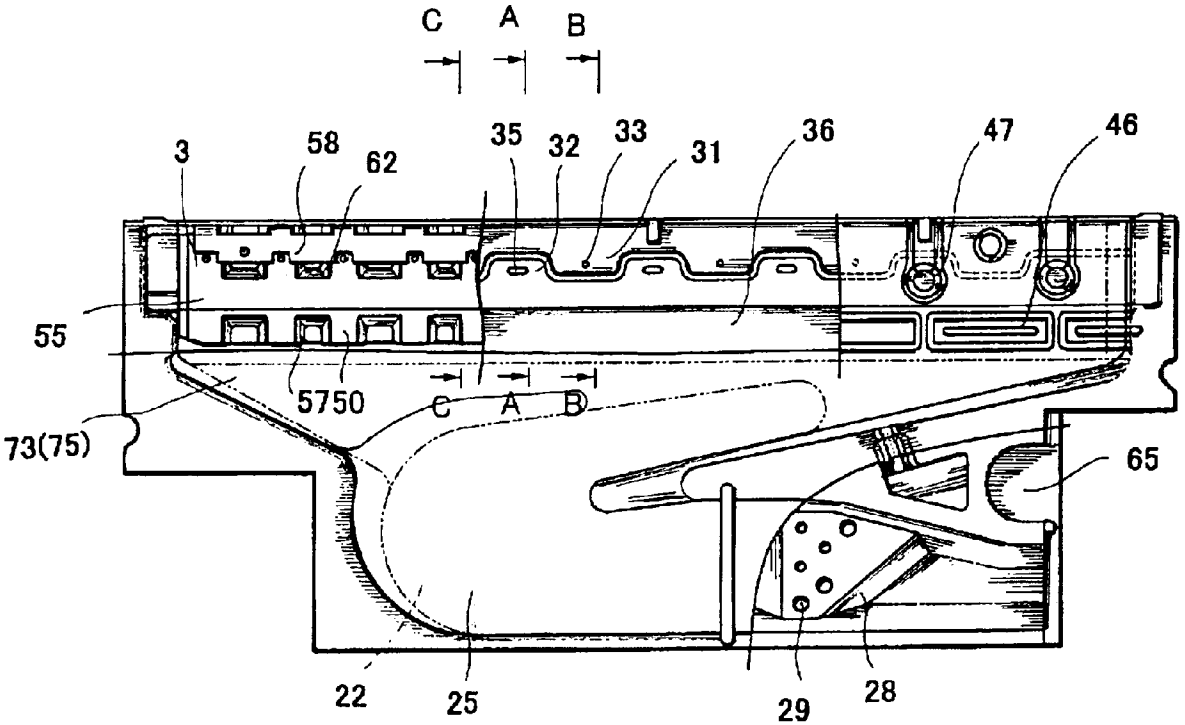
FIG. 15 is a front elevation of the apparatus shown in FIG. 1, with some parts being cut off.

The burner port holder 27 disposed in the top of principal part 5 extends over the full length thereof. Opposite ends of the burner port holder 27 are formed as vertical grooves 24 each extending upright and over full height of said holder 27. Opposite vertical ears 69 of the burner port assembly 3 will fit in the respective vertical grooves 24 so as to hold this assembly in position, as will be detailed later. As shown in FIGS. 2 and 15, protuberances 31 protruding out sideways from each side of the holder 27 do alternate with flat basal portions 32 in a longitudinal direction thereof. The protuberances 31 are positioned corresponding to collateral burner ports 61*a* each of a smaller opening and formed in the burner port assembly 3, with the flat basal portions 32 corresponding to further collateral burner ports 61*b* each of a larger opening and also formed in said assembly 3.

Communicating openings 33 and 35 opened outwards from the interior of principal part 5 are formed in and through the protuberances 31 and flat basal portions 32, respectively. Each communicating opening 33 in each protuberance (or 'recess' if viewed from inside) 31 is a round hole, and each of the other openings 35 in basal portions (or 'protrusions' if viewed from inside) 32 is an elongated hole of a larger opening than the round hole. Consequently, the gas will flow through each communicating opening 35 at a higher rate than through each round opening 33. Outer wall surfaces of the principal part 5 serves as the portions of walls defining the thick gas passage 73, also serving as a space 63*a* for defining auxiliary burner ports 63. The round communicating openings 33 and 35 formed in the passage leading to this auxiliary burner ports 63 are in communication with both the collateral burner ports 61*a* and 61*b*.

Longitudinal groove 36 is formed in the sidewall of burner port holder 27 and below the protuberances 31 and basal portion 32. This groove 36 extending over full length of and protruding out sideways from the burner port holder 27 is intended to enhance its rigidity and to balance one another the gas mixture flow rates through the respective burner ports.

Similarly to the principal part plates 7 and 8, each of the further plates 10 and 11 constituting the supplementary part 6 and sandwiching principal part 5 is also prepared by pressing a metal plate in a manner shown in FIGS. 2 and 4. Each of these plates 10 and 11 symmetrical with each other is of a recessed shape as a whole. Their two opposite vertical sides and their bottom sides, except for their side portions adjacent to the air intake 16, have flanges 37 or 38.

Each plate 10 and 11 of the supplementary part 6 has a relatively recessed region 40 corresponding to the principal part's 5 thin gas mixing chamber 25, generally in conformity therewith.

Each plate 10 and 11 is expanded out above the recessed region 40 that has an upper end 40*c* in parallel with the top and bottom of each plate. This upper end 40*c* extends towards the air intake 16 from each plate's innermost portion remote from the air intake 16, by a distance of about one third of each plate. Upper regions above the upper ends 40*c* define the bulged passage 43 for the thick gas mixture, and this passage has a slanted border 43*c* extending towards the air intake 16. Oblique grooves 45 serve to communicate the bulged passage 43 to a region adjacent to the air intake 16.

As shown in FIGS. 1 and 4, a straight array of unit dams 46, a group of round recesses 47*a* and a group of rectangular recesses 47*b* are arranged in the uppermost region of each plate 10 and 11. The number of unit dams 46 is 8 (eight), and an inter-dam canal 46*a* is formed between the adjacent two unit dams 46.

Each round recess 47*a* is disposed above the corresponding inter-dam canal 46*a*. Each of the rectangular recesses 47*b* continues from the corresponding round recess 47*a* and extending to the top of each constituent plate 10 and 11 of the supplementary part. The unit dams 46 and the round recesses 47*a* are all depressed inwardly of the burner body 2. Thanks to these structural elements, fuel gas will be assisted to intermix well and quickly with air, to thereby ensuring stable formation of flames out of the auxiliary burner ports 63. In addition, those round recesses 47*a* will serve as portions that are welded to the neighboring portion s when assembling the burner body 2.

Figure 12A:
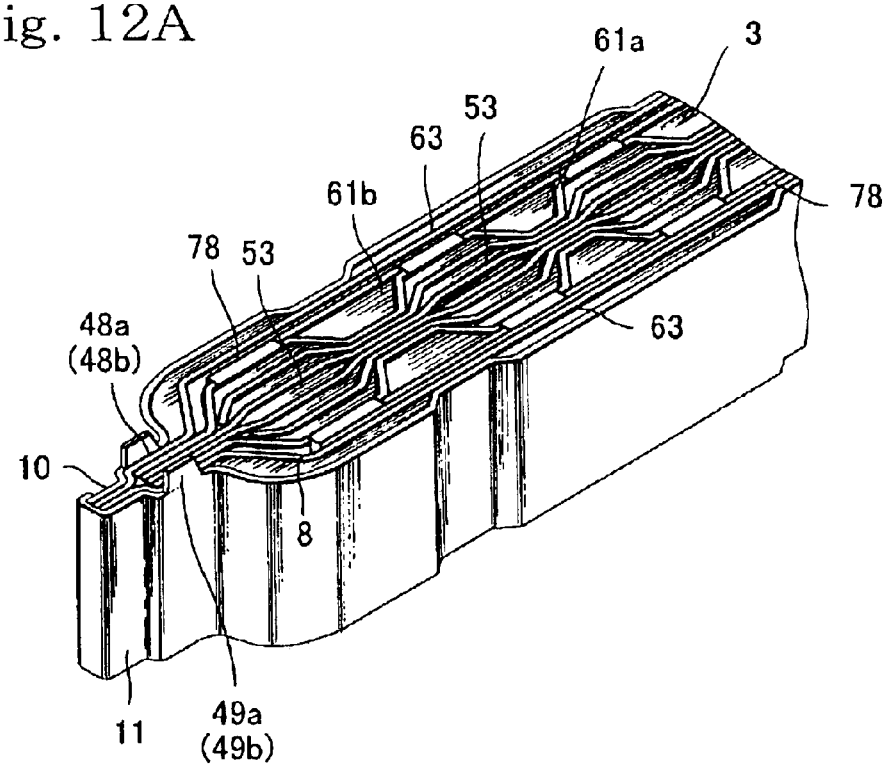
FIGS. 12*a* and 12*b* are fragmentary perspective views of the apparatus shown in FIG. 1 and being manufactured.
Figure 12B:
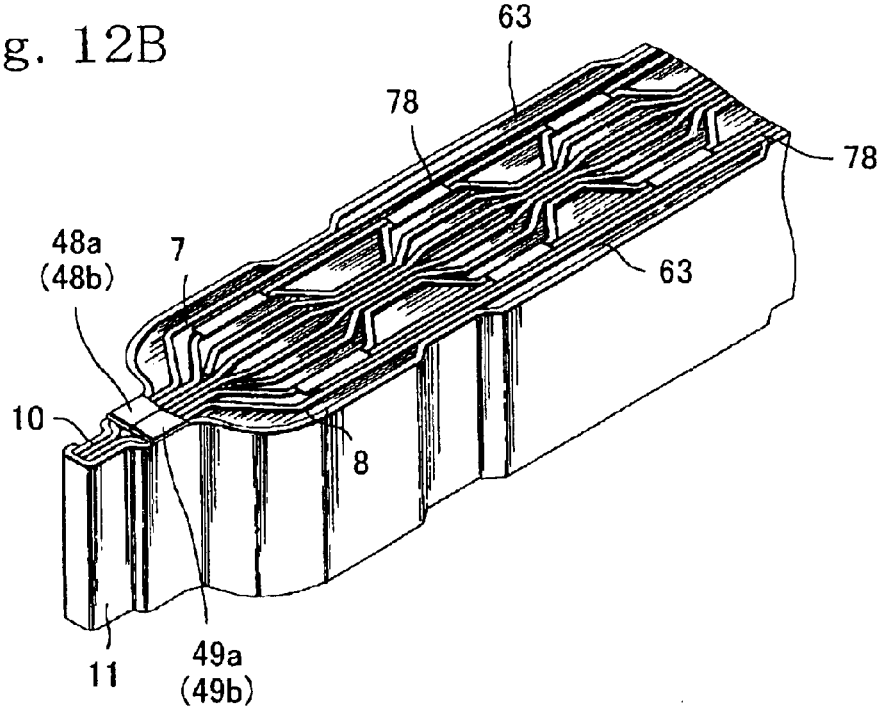

Opposite side flanges 37 and 38 of each supplementary plate 10 and 11 have upper end regions formed as retaining tabs 44*a* and 44*b* that are located close to the burner port holder 27. These tabs 40*a* and 40*b* are shaped in conformity with the vertical grooves 24 of the burner port holder 27 which the principal part 5 comprises. Upward ears 48*a* and 48*b*, or 49*a* and 49*b*, are integral with the tops of those tabs 44*a* and 44*b* and disposed to face said grooves 24, as seen in FIGS. 2 and 12*a*. FIG. 12*b* shows that those ears 48*a* to 49*b* are bent inwards to shut off the vertical ears 69 of burner port assembly 3, at their upper ends close to flames.

Figure 8:
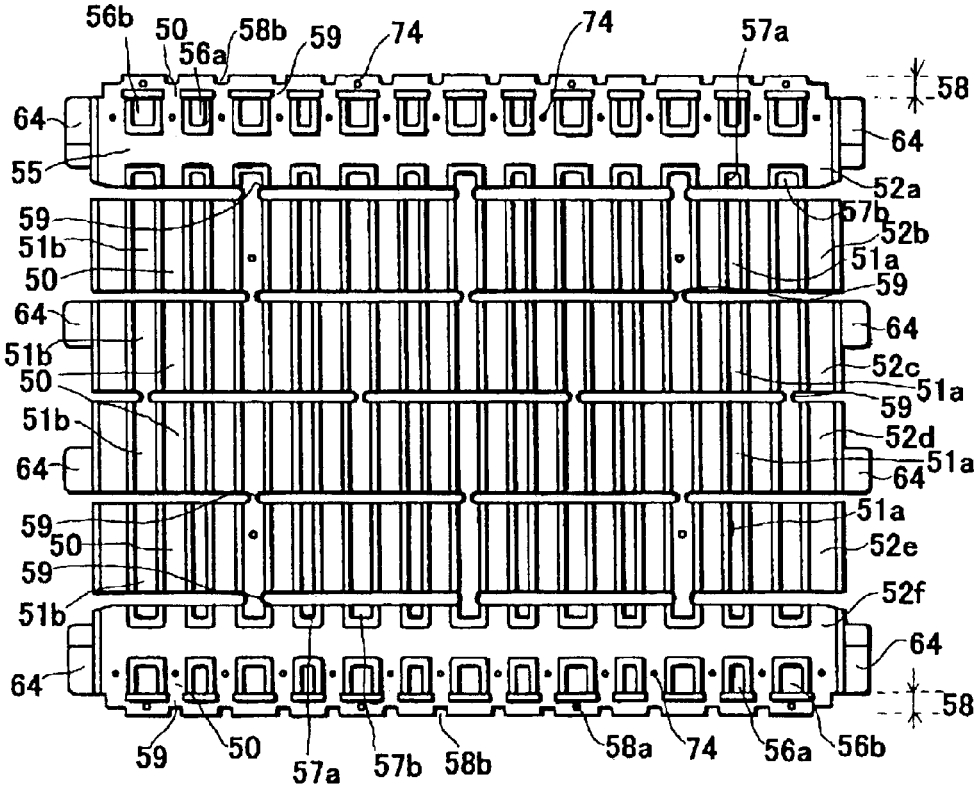
FIG. 8 is a plan view of the member constituting a burner port to be incorporated in the apparatus shown in FIG. 1.
Figure 9:
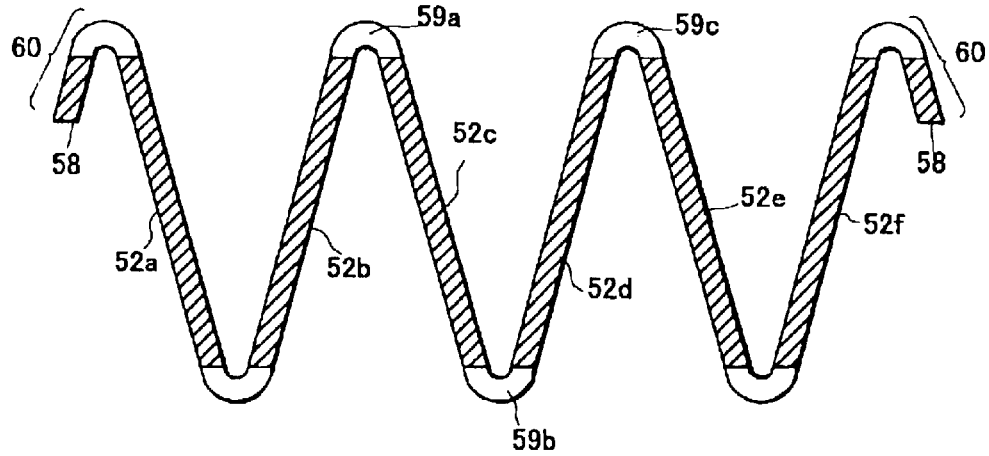
FIG. 9 is a scheme illustrating the process of manufacturing the burner port for the apparatus shown in FIG. 1.

FIG. 8 shows that the burner port assembly 3 is made of a prefabricated steel plate having formed therein rectangular burner port wall segments 52 (viz., 52*a*, 52*b*, 52*c*, 52*d*, 52*e* and 52*f*) and rectangular bands 58 integral with the outermost segments 52*a* and 52*f*. Each wall segment 52 has ridges 50 and valleys 51*a* and 51*b*, and the adjacent wall segments 52 are connected one to another by narrow and short tie portions 59. FIG. 9 illustrates how to fold the prefabricated steel plate in six at these tie portions 59, so as to provide a generally square column.

The ridges 50 in the adjacent two burner port wall segments 52 will overlap each other, and at the same time the valleys 51 in these adjacent wall segments 52 also overlap each other, when these segments are folded back one on another. It will be seen in the drawings that the ridges 50 formed in the outer wall segment protrude, perpendicularly to its face, significantly higher than the other ones in the inner segments. It also will be noted that the ridges 50 in all the wall segments 52*a* to 52*f*, as well as the valleys 51*a* and 51*b* in the inner four wall segments 52*b* to 52*e*, do all extend transversely of the respective segments. Thus, the burner port assembly 3 manufactured by folding such a prefabricated steel plate in the described manner, will have an array of main burner ports 53 provided as clearances opened up and down between the adjacent ridges 50.

The 'valleys' 51 is a general term for narrower valleys 51*a* of a smaller width 'W1' and broader valleys 51*b* of a larger width 'W2'. The narrower valleys 51*a* and the broader valleys 51*b* alternate with one another longitudinally of each rectangular burner port wall segment, with one ridge 50 intervening between the adjacent two valleys 51*a* and 51*b*. The narrower valleys 51*a* in the adjacent two of segments 52*a* to 52*f* will contact each other. In this way, the burner port assembly 3 has smaller nodes 54*a* formed by folding back these segments one on another. Likewise, the broader valleys 51 in these two segments 52 also contact each other to provide larger nodes 54*b*. In more detail, the smaller nodes 54*a* alternate with the larger nodes 54*b* longitudinally of the burner port assembly 3.

Figure 11:
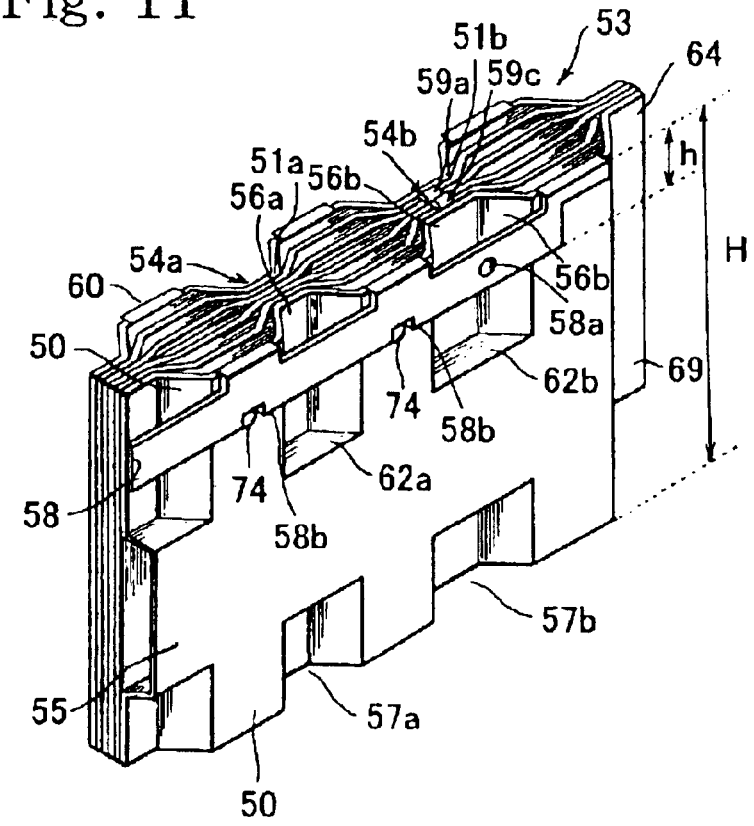
FIG. 11 is an enlarged fragmentary perspective view of the burner port shown in FIG. 10.

In the burner port assembly 3, the tie portions 59 (viz., 59*a*, 59*b* and 59*c*) are bent up and down as shown in FIGS. 9 and 11. The bent tie portions 59*a* and 59*c* at the top of the assembly 3 will serve as targets for electro-static arcs emitted from an igniter 81 disposed above this assembly.

Figure 10:
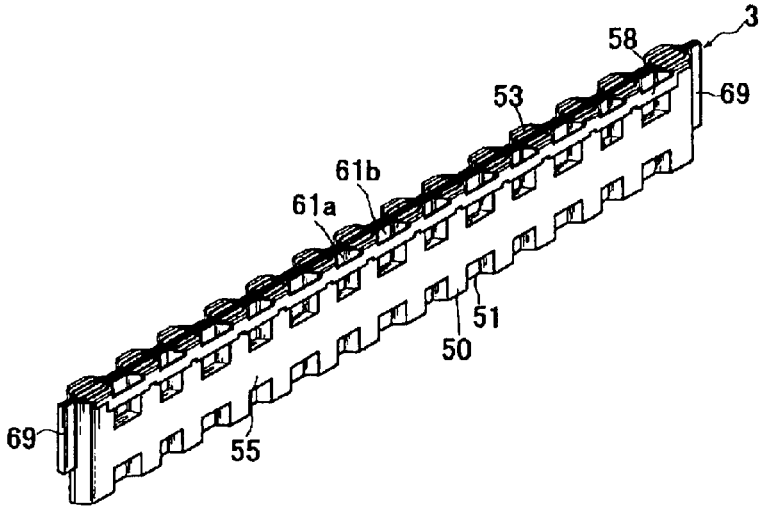
FIG. 10 is a perspective view of the burner port for the apparatus shown in FIG. 1.

Communicating openings 74 formed in and through the portions of outermost wall segments 52*a* and 52*f* (said portions forming the ridges 50 in burner port assembly 3) communicate the inside with the outside of each main burner port 53. FIGS. 8, 10 and 11 show that a hollow bulge 55 is formed longitudinally of and in each of the outermost segments 52*a* and 52*f*, in addition to the ridges 50 and valleys 51*a* and 51*b*. Such hollow bulges 55 are the burner port assembly's 3 protuberances facing outwards, and each vertically extending ridge 50 intersects each hollow bulge 55 such that their internal cavities communicate with each other. Thus, the cavities of the neighboring ridges 50 do also communicate with each other. However, each hollow bulge 55 divides each of valleys 51*a* and 51*b* into an upper recess 56*a* or 57*a* and a lower recess 56*b* or 57*b*, such that each upper recess 56*a* and 57*a* is isolated from the corresponding lower recess. In other words, the upper recesses 56*a* and 56*b* are disposed only in the upper region of each outer burner port wall segment 52*a* and 52*f*, with the lower recesses 57*a* and 57*b* being separately disposed in the lower region.

FIGS. 8, 10 and 11 further show that the outermost wall segments or bands 58 are formed by bending outwards the top portions of outer segments 52*a* and 52*f*. Thus, bent portions and each band 58 continuing therefrom constitute as a whole a flame stabilizer 60. This stabilizer inclusive of said band continues from the main burner ports 53 will increase surface area, effective volume and consequently heat capacity of these burner ports. Height 'h' of the bands 58 is smaller than height 'H' of the burner port wall segments 52. Several lugs 58*a* arranged at intervals on the outer face of each band 58 do protrude out therefrom. The upper recesses 56*a* and 56*b* in each outer wall segment 52*a* and 52*f* are covered in part by the band 58. There are cutouts 58*b* at the band's 58 portions corresponding to the communicating openings 74 so that these openings 74 are exposed to the outside. Also, a lower half of each upper recess 56*a* and 56*b* is exposed to the outside, thereby providing side openings 62 (viz., 62*a* and 62*b*) in the burner port assembly 3.

As will be seen in FIG. 12*a*, supplementary burner ports 61*a* and 61*b* are cavities each defined by and with the upper recess 56*a* or 56*b* of outer wall segment 52*a* or 52*b* and the band 58. Thus, each cavity as the supplementary burner ports 56*a* and 56*b* are disposed in the node 54*a* or 54*b* adjacent to the corresponding main burner ports 53. The neighboring supplementary burner ports 61*a* and 61*b* are separated from each other by the flame stabilizer 60. The supplementary burner ports 61*a* have openings smaller than the other supplementary burner ports 61*b*.

Four of the wall segments 52*a*, 52*c*, 52*d* and 52*f* have each at their opposite ends tab-shaped ears 64 as shown in FIG.

8. Thus, the burner port assembly 3 has at its opposite ends the vertical ears 69 that are formed each by consolidating the tab-shaped ears 64 together. These vertical ears 69 tightly fit in the respective vertical groove 24 formed in burner port holder 27 in order to firmly hold the burner port assembly 3 in position.

Figure 14:
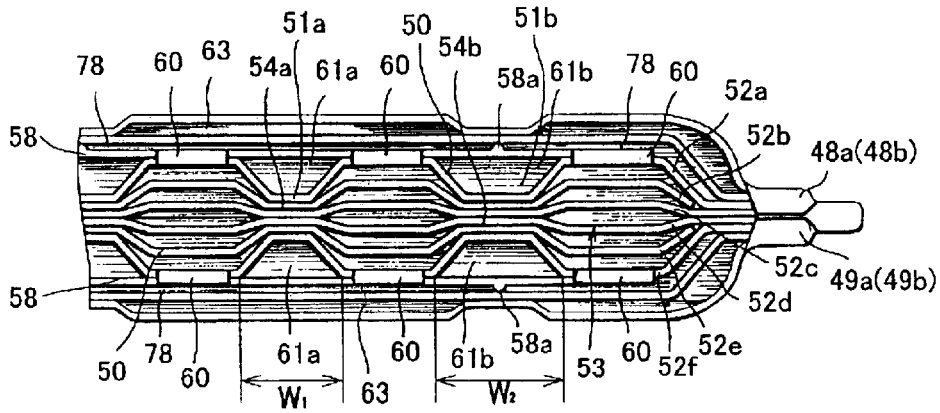
FIG. 14 is an enlarged fragmentary plan view corresponding to FIG. 13.

As noted above, each band 58 disposed outermost in the burner port assembly 3 has the outward lugs 58*a*. A gap is formed between this assembly and each of the plates 7 and 8 constituting the principal part 5, as seen in FIGS. 14 and 18, so as to provide an intermediate burner port 78 extending longitudinally of said assembly 3. The main burner port 53 communicates with such intermediate burner ports 78 by means of the communicating openings 74.

Figure 13:
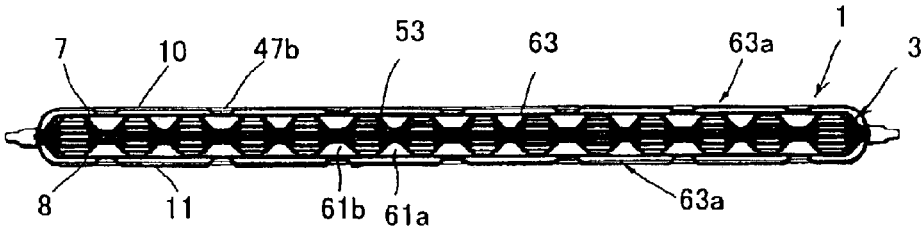
FIG. 13 is a view of the apparatus shown in FIG. 1 and seen in the direction 'A'.

The space 63*a* to form an array of auxiliary nozzles is present between the outer face of each plate 7 and 8 of the principal part 5 and the inner face of each plate 10 and 11 of the supplementary part 6, as seen in FIGS. 1 and 13. The rectangular recesses 47*b* in the plates 10 and 11 divide each of such spaces 63*a* into several regions serving as the auxiliary burner ports 63.

Next, some complementary explanations will be given on relationships between the components of the combustion apparatus 1 provided in the present embodiment. As best seen in FIG. 2, the principal part 5 composed of the plates 7 and 8 is positioned centrally of this apparatus and sandwiched by and between the plates of supplementary part 6. The burner port assembly 3 is held in and secured to the top of such a principal part 5. The principal and supplementary parts 5 and 6 are made integral with each other at their flanges 17, 37 and 38 spot welded or otherwise joined together. For example, consolidation of the principal and supplementary parts 5 and 6 is carried out primarily by welding one central plate 7 to one side plate 10, and also welding the other central plate 8 to the other side plate 11. Further, those parts 5 and 6 are forced into an interference-fit engagement with each other by caulking the thin gas chamber fragments 25*a* onto the recessed fragments 40*b*, thereby forming the ribs 14 at the caulked portions of these fragments. In practical manufacture, the principal part 5 will be fixed on the supplementary part 6 at first, before folding double the latter part at and along its center line and subsequently conducting the welding and edge-bending or the like processes.

The burner port assembly 3 is inserted in the burner port holder 27 formed in the principal part 5. At a middle height of the burner port assembly 3, its hollow bulges 55 protruding out from the burner port wall segments 52*a* and 52*f* are in contact with the respective plates 7 and 8 of principal part 5. However, the outermost side portions of the burner port to assembly 3 are the lugs 58*a* jutting out from the bands 58. These bands 58 contact these plates 7 and 8 only at said lugs 58*a*, to thereby define between each plate and each band the inter-mediate burner ports 78.

With the burner port assembly 3 being inserted into the holder 27, the straight array of flat basal portions 32 of the principal part 5 will come into proximity of the outer wall segments 52*a* and 52*f*. In this state, the side openings 62 present in the upper recesses 56*a* and 56*b* of these wall segments 52*a* and 52*f* are in communication with the communicating openings 33 and 35 that penetrate the protuberances 31 and flat basal portions 32, respectively. Thus, those openings 62 will serve as a means (or 'communication holes') for distributing the fuel gas mixture.

Upward ears 48*a*, 48*b*, 49*a* and 49*b* on the top of supplementary part 6 are bent in towards the center line of apparatus 1 as shown in FIG. 12*b*, so that the vertical ears 69 of burner port assembly 3 is kept in place. These ears 48*a* to 49*b* define opposite boundaries for the flames jetted from this assembly 3, and preventing any flame from being emitted up from the vertical ears 69 thus closed.

The principal part 5 is in contact with the side supplementary plates 10 and 11 only at its regions located near the air intake 16, located near the thin gas mixing chamber 25 and at the tie walls 19. In other words, all the areas and zones except for these regions of principal part 5 are spaced apart from the supplementary plates 10 and 11. Side walls 16*a* and 16*b* as well as bottoms 16*c* and 16*d* (all included in the contour of the air intake 16 in principal part 5) are in close contact with the side plates 10 and 11, leaving no clearance between them as seen in FIGS. 1 and 16.

The welding of side plates 10 and 11 of the part 6 to the central plates 7 and 8 of the part 5 will be done within round recesses 47*a* formed near the top of the former plates 10 and 11. The main and auxiliary burner ports 53 and 63 are located in proximity of the round recesses 47*a*, so that the latter will protect plate regions adjacent thereto from deformation due to high temperatures.

Thus, those plates' portions very close to burner port fragments are preferably welded.

Such round recesses ('protrusions' if seen from inside) 47*a* welded to the principal part 5 have their inner faces in contact therewith, thereby producing and keeping a clearance around them.

An opening 65 defined by and with the portions of side plates 10 and 11 is much larger than the air intake 16, with the top thereof being spaced apart from the ceiling of the larger opening 65. Thus, a kind of duplex hole is provided near the bottom of burner body 2, wherein the lower hole is the air intake 16 and the upper hole is the fuel intake 66.

The central plates 7 and 8 have near their lower corners respective cut outs that are positioned above the air intake 16 and included in the fuel intake 66. The communication hole 20 of the principal part 5 is located near the cutouts, thus providing a comparatively broad space 67 disposed above the air intake 16 and exposed to the outside. A combination of this space 67 with a further space 68 around the venturi 23 serves as the blending station 70 mentioned above.

Since the ceiling of air intake 16 serves as the bottom of fuel intake 66 in such duplex structure, any idle space that would make the apparatus taller is not involved here. The fuel intake 66 overlying the air intake 16 is located closer to all the main, collateral and auxiliary burner ports 53, 61*a*, 61*b* and 63, and the air intake 16 is more remote therefrom.

Figure 17A:
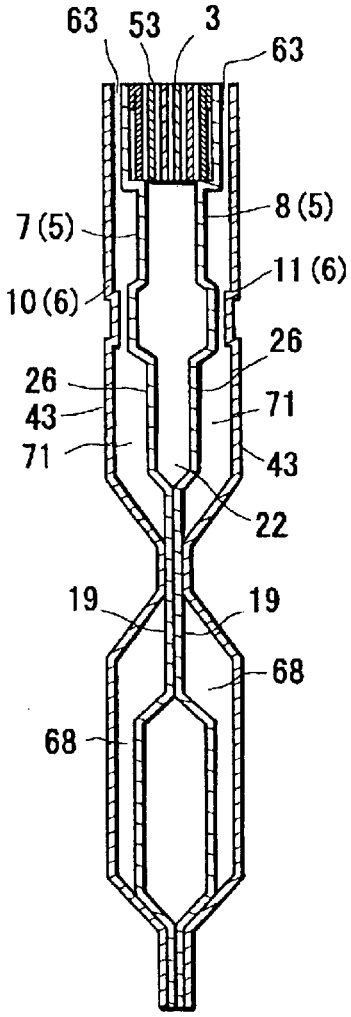
FIG. 17*a* is a cross section taken along the line B—B in FIG. 1.
Figure 17B:
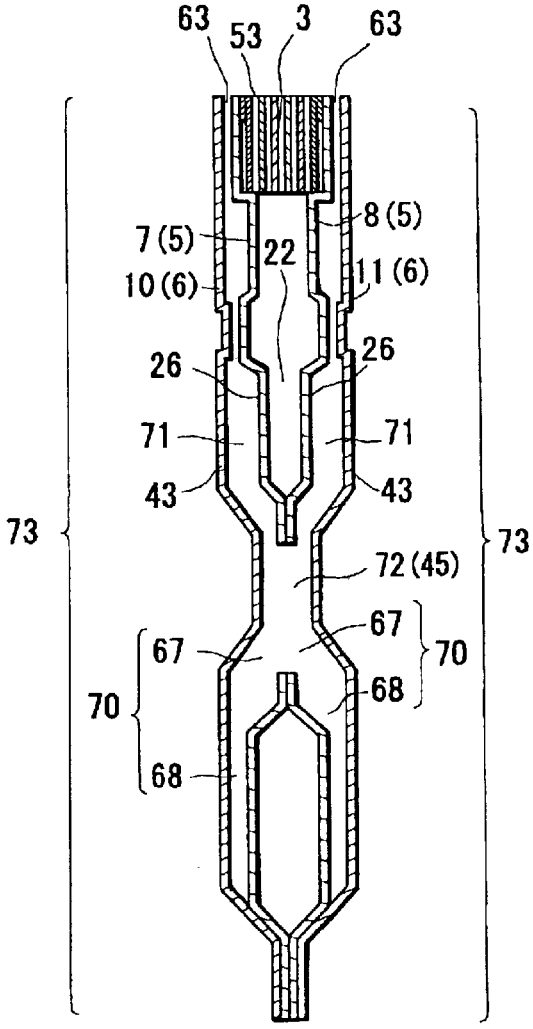
FIG. 17*b* is a cross section taken along the line C—C in FIG. 1.

As seen in FIGS. 16, 17*a* and 17*b*, the further space 68 is present around the principal part's venturi 23 and between it and supplementary part 6. Thus venturi 23 is not in contact with the supplementary part except for its bottom, but is surrounded by the space 68.

Figure 6A:
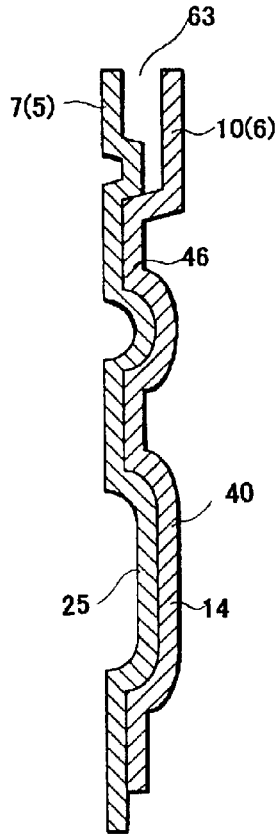
FIG. 6*a* is a cross section taken along the line D—D in FIG. 5.
Figure 6B:
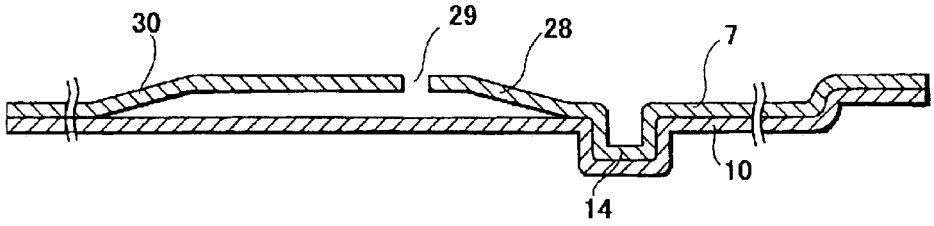
FIG. 6*b* is a cross section taken along the line E—E in FIG. 5.

The thin gas mixing chamber 25 of principal part 5 is in a close contact with the recessed region 40 of supplementary part 6, as shown in FIG. 6. These chamber 25 and region 40 are in a tight engagement with each other at the rib 14 so that any amount of gas flowing by the venturi 23 does not float in between them 25 and 40. The rib 14 thus serves as a member for shutting the space 68 around the venturi 23.

As seen in FIGS. 17*a* and 17*b*, a still further space 71 separates the bulged thick gas passage 43 from the inner principal part 5. However, the communication channel 26 is made thinner than the neighboring zones, so that a wider cavity is provided beside this passage. The said further space 71 extends along the thin gas passage 22 and over the full length of the principal part 5.

FIG. 17*a* shows also that the tie walls 19 are in a close contact with the inner faces of supplementary part 6 so that the upper space 71 is almost separated from the lower space 68 located at the lower and side region of said principal part 5. These spaces 71 and 68 communicate with each other only through the oblique grooves 45. These grooves 45 are formed in said supplementary part 6 so as to bring into communication the proximity of air intake 16 with the bulged thick gas passage 43, which in turn communicates with the fuel intake 66. On the other hand, the tie walls 19 are flat portions interposed between the side plates 10 and 11, thus providing there the constricted canal 72 summarized hereinabove.

More details of this canal 72 as a part of the thick gas passage 73 will now be given below referring to FIG. 16. The communication hole 20 formed in the tie walls 19 is located near the constricted canal 72, which faces the center in fore-and-aft direction of an expanded or flared canal 75 formed as another part of said thick gas passage 73. The bulged regions of side plates 10 and 11 have, adjacent to the communication hole 20, their lower borders extending across the obliquely upward extension of this hole 20. Thus, the constricted canal 72 is in communication with both the upper and lower spaces 71 and 68. As seen in FIGS. 16 and 17*b*, a lower end or half region of constricted canal 72 encircling the upper end of upward extension of communication hole 20 is a completely hollow cavity without any obstacles. However, an upper end or half region of this canal 72 is divided by the portions of tie walls 19 into cells separated one from another and arranged side by side.

In such a seriate manner described above, the thick gas passage 73 is provided between the principal part 5 and the supplementary part 6 (composed of the side plates 10 and 11), with the constricted canal 72 bringing the lower space 68 into communication with upper space 71. The open top of the downstream end of this passage 73 functions as the auxiliary burner ports 63. The straight row of main burner ports 53 and the collateral burner ports 61*a* and 61*b* constitute a kind of burner port block, which intervenes between the side rows of such auxiliary burner ports 63. In the combustion apparatus 1 of this embodiment, the upper space 71 communicating with the auxiliary burner ports 63 serves as the expanded or flared canal 75 constituting the thick gas passage 73. On the other hand, the constricted canal 72 connecting the lower space 68 to upper space 71 serves as a thick gas feed route to supply the expanded canal 75 with the thick fuel gas mixture.

In more detail, there are gaps arranged side by side, and one of them being defined between one plate 7 of the principal part 5 and one plate 10 of the supplementary part 6. The other gap is defined between the other plate 8 of principal part 5 and the other plate 11 of supplementary part 6. Lower regions of these gaps communicate with upper regions thereof through the constricted canal 72. The open top of the expanded canal 75 as a part of the thick gas passage 73 works as the auxiliary burner ports 63.

The constricted canal 72 in this embodiment bridges a gap between the lower space 68 and the upper space 71 defining the expanded canal 75, in order to blow the thick gas mixture thereinto. There is no passage between the upper and lower spaces 71 and 68 other than such a constricted canal 72. The thick gas mixture from the blending station 70 will thus flow through the constricted canal 72 into the expanded canal 75 and then towards the auxiliary burner ports 63.

As will be seen in FIG. 16, a comparatively wide space 67 is provided near the side end, and more particularly above the air intake 16. This space 67 exposed to the outside is intended to function as a part of the blending station 70. Due to the thinned venturi 23 in the principal part 5, the comparatively large lower space 68 is defined between this venturi and the side plates 10 and 11. These spaces 67 and 68 cooperate with each other to serve as a whole as the blending station 70 for mixing the fuel gas and air. In addition, the lower space 68 will serve as a part of the thick gas passage 73 for flowing the gas mixture prepared in the blending station 70.

The blending station 70 in this embodiment has a cross-sectional area that is constricted at first and then expanded again.

In detail, the side plates 10 and 11 are in contact with the tie walls 19 of the principal part 5, as shown or seen in FIGS. 2 and 16. As shown in FIG. 17*a*, the lower spaces 67 and 68 forming the blending station 70 is separated from the upper space 71 forming the expanded canal 75 in the thick gas passage 73. The area where the tie walls 19 contact the side-walls 10 and 11 has an upper border formed as an inclined side 76 (see FIG. 2) of the bulged thick gas passage 43. On the other hand, a lower border of the said area is a further inclined side 77 (see FIG. 2) such that the upper inner wall of the blending station 70 is slanted along this further side 77 to descend downstreamly of the gas mixture flow. The upper outer wall of the air intake 16 ascends at first downstreamly of airflow, and then at the tapered region 28, descends sharply.

In this way and as seen in FIG. 16, the blending station 70 starting from the fuel intake 66 is tapered off to gradually reduce its cross-sectional area downstreamly of the gas mixture flow, until it leads to the communication hole 20. At this point, the tapered region 28 defining the venturi 23 causes the blending station 20 to sharply increase its cross-sectional area and continue to the space 68. In short, the blending station 70 is tapered off between the fuel intake 66 and the tapered region 28, where it has a minimum cross-sectional area, and thence sharply increases its cross-sectional area downstreamly of the gas flow.

The fuel gas and air fed into the fuel intake 66 will form a rough mixture to be divided into right and left tributaries. They will advance then towards the communication hole 20 so as to be mixed further while being accelerated in velocity due to the gradual decrease in cross-sectional area of the flow passage. As they progress beyond the region of minimum cross-sectional area, they will be allowed to expand and lower their velocity due to the subsequent sharp increase in cross-sectional area. Those tributaries merge one another through the hole 20 temporarily for a short time, so that they are equalized in pressure, before separated again from each other to further advance towards the burner ports.

The combustion apparatus 1 may comprise an igniter 81 to infla me the fuel gas mixture jetted from the top 15 of this apparatus.

Now, flows of fuel gas and air will be discussed in detail.

In the combustion apparatus 1 of the embodiment, a fuel feed nozzle 80 will be inserted in the fuel intake 66 above the air intake 16, in order to receive the fuel gas and ambient air. A fan or blower (not shown) disposed upstreamly of the burner body 2 comprising these air intakes 16 and fuel intake 66 will supply them with air streams. The ratio in amount of air to fuel gas will be set at about 40% of a theoretical value, thus rendering the mixture very rich in fuel gas. The fuel nozzle 80 inserted in the fuel intake may be kept in a condition similar to usual Bunsen burners. Thus, a certain annular gap will be present between the outer periphery of the fuel nozzle 80 and the inner periphery of fuel intake 66, so that the ambient air enters this apparatus together with the fuel gas. The ratio of air to fuel gas is about 40% of theoretical value as noted above, whilst the air intake 16 receives only the ambient air.

Such a raw mixture of fuel gas and air will further be blended within the blending station 70. This station 70 substantially consisting of the spaces 67 and 68 will gradually reduce cross-sectional area, towards its downstream side. Consequently, fuel gas and air are forcibly mixed with each other to form a preferably thick gas mixture.

In detail, the fuel gas and the ambient air having flown in through the fuel intake 66 advances at first towards the mixing accelerator 18. Here, the rough mixture will be caused to follow the curvature of burred semicircular and transverse protrusions 18*b*. Because of convergence on the surface of these protrusions, partial streams of the rough mixture will collide with each other. Thus, the rough mixture will be divided into right and left tributaries, which subsequently encounter decrease in cross-sectional area of flow passage and consequently increase their flow velocity as they rush towards the communication hole 20.

The space 68 around this hole increases cross-sectional area of flow passage, so that the tributaries will lower their flow speed. Simultaneously, they merge for a time through the communication hole 20 to be equalized in pressure and well mixed to give a homogeneous gas mixture.

A part of thick gas mixture well homogenized in the blending station 70 will flow upwards and enter the expanded canal 75 through the constricted canal 72 shown in FIG. 17*b*. The expanded canal 75 disposed above the constricted canal 72 also constitutes the gas passage 73. Since the constricted canal 72 is slanted in fore-and-aft direction and towards the center of expanded canal, the well-mixed thick gas mixture will instantly spread throughout this canal 75. Subsequently, the gas mixture flowing up along the wall of principal part 5 will uniformly flow through the inter-dam canals 46*a* each defined between the adjacent two unit dams 46, so as to be jetted out uniformly from the auxiliary burner ports 63 overlying the interdam canals 46*a*.

Although air content is merely about 40% of theoretical value to render the gas mixture entering the passage 73 extremely rich in fuel gas, the fuel gas will however be mixed well with the ambient air within the apparatus 1 of the embodiment. This feature results from the sufficient decrease in cross-sectional area of the passage in blending station 70 and also from the constricted canal 72 which the mixture has to flow through before entering the expanded canal 75 (space 71).

The upper end region of communication hole 20 is surrounded by the entrance portion of constricted canal 72 such that said region is quite hollow. However, middle and exit portions of the canal 72 are divided into right-hand and left-hand halves by the presence of tie wall portions 19 disposed in said canal. Effective cross-sectional areas of those halves of canal 72 depend almost solely on the cross-sectional area of respective middle portions of said halves. On the other hand, precise ratio in cross-sectional area of the right half to the left half depends on preciseness of the pressing process to form such a constricted canal 72.

This canal 72 consists of a groove 45 formed by pressing a metal plate when preparing the side plates 10 and 11. The inner surface of the middle region of such a groove 45 is of the highest precision in dimension among all the regions and portions formed in each plate 10 and 11.

It is noted here that the constricted canal 72 formed in the side plates 10 and 11 does connect the upper space 71 to lower space 68 in fluid communication as shown in FIG. 17*b*, as if it were a bridge spanned between these spaces. On the other hand, the plates 10 and 11 are in contact with the tie walls 19 of principal part 5 at a zone, and an upper border of this zone is the inclined side 43*c* of bulged thick gas passage 43.

A lower border of such a zone is the other inclined side 43*d* lying in parallel with the first mentioned side 43*c*.

The constricted canal 72 in this embodiment is therefore formed almost at right angles with these sides 43*c* and 43*d*, for realizing preciseness in its pressed shape and dimension.

The thick gas mixture prepared in the blending station 70 of apparatus 1 will then be divided into accurate halves, that is right-hand and left-hand tributaries, to flow in parallel with each other through the middle and downstream regions of the constricted canal 72. Inclination of constituent parts of this slanted canal 72 scarcely varies among them so that said tributaries will not fluctuate in their angle jetted into expanded canal 75 of gas passage 73. Thus, such a canal 72 contributes to production of a well-balanced pair of right and left auxiliary flames of a highly homogeneous gas mixture delivered from the blending station. By virtue of such an inclination of constricted canal 72, each array of auxiliary burner ports 63 will receive the gas mixture uniformly over its full length, thereby affording an improved inflammability of steadier auxiliary flames free from any variation in the force thereof.

Auxiliary flames are now less likely to be fanned by the air flowing into this apparatus 1, thanks to uniform distribution of the gas mixture to all the regions of auxiliary burner ports 63. Easier inflammation, smoother propagation and surer distinguishing of those flames are ensured, preventing in-complete combustion and flame oscillation even when operation of this apparatus is in any transitional state.

Figure 18A:
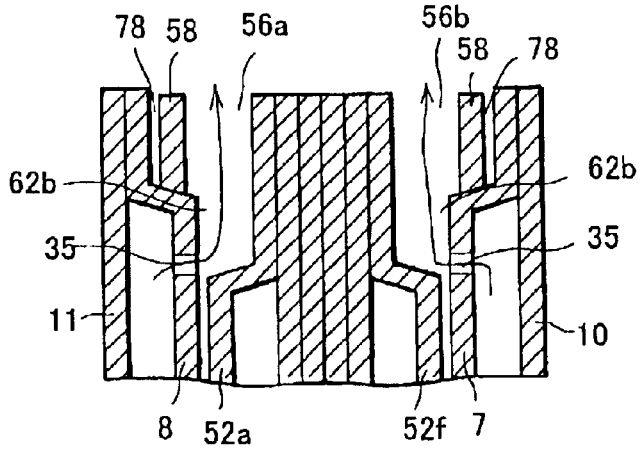
FIG. 18*a* is a cross section taken along the line A—A in FIG. 15.
Figure 18B:
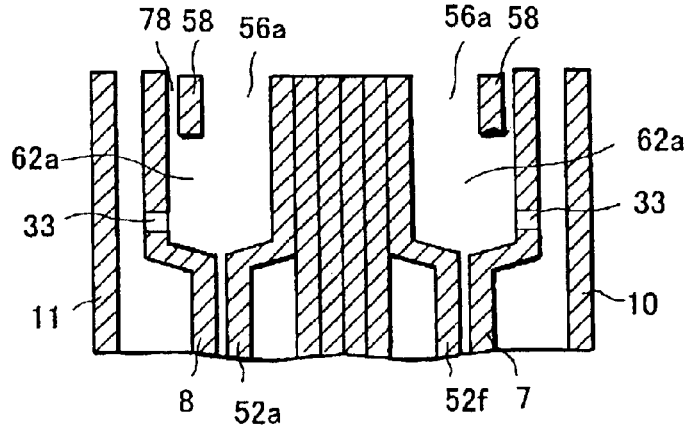
FIG. 18*b* is a cross section taken along the line B—B in FIG. 15.
Figure 18C:
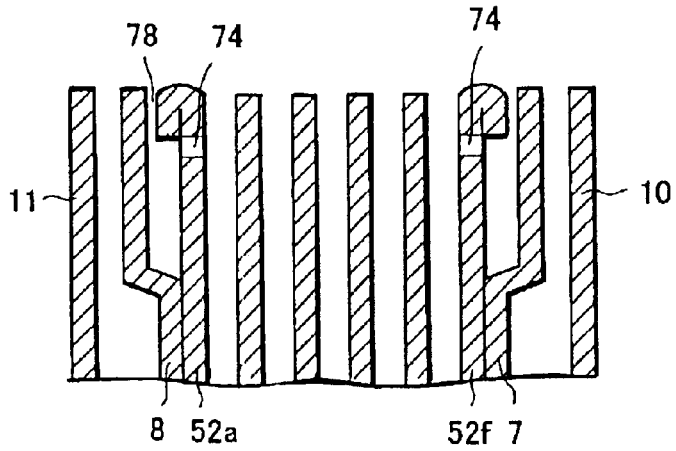
FIG. 18*c* is a cross section taken along the line C—C in FIG. 15.

The major part of gas mixture spread all over the expanded canal 75 (space 71) in thick gas passage 73 is spouted out from auxiliary burner ports 63 overlying said canal 75. The balance of such a gas mixture will however be directed to the burner port assembly 3, through the communicating openings 33 and 35 penetrating the protuberances 31 and flat basal portions 32 formed in principal part 5. FIGS. 18*a* to 18*c* are now referred to, for the purpose of a more detailed description of this feature.

FIG. 18*a* is the cross section taken along the line A—A in FIG. 15 to show the communicating openings 35 in principal part 5. These openings 35 are, as discussed above, elongated holes that are formed in the upper flat portions ('protuberances' if seen from the inside) 32 of the principal plates 7 and 8. The upper and larger recesses 56*b* of the outer wall segments 52*a* and 52*f* constituting the burner port assembly 3 do face the respective elongated openings 35, that are positioned below the band (i.e., outermost segment) 58. More particularly, those communicating openings 35 are located to respectively face the exposed side openings 62*b* as the regions of said recesses 56*b*.

The height 'h' of band 58 is much smaller than height 'H' of those corrugated burner port wall segments 52*a* and 52*f*. Thus, each band 58 covers only the upper halves of upper recesses 56*a* and 56*b*, leaving the remainder thereof 62*a* and 62*b* exposed to the outside as free openings 62*a* and 62*b*. Therefore, communicating openings 35 in the principal part's 5 plates 7 and 8 do face the larger ones 62*b* of such exposed openings in the burner port assembly 3.

As described above, the communicating openings 35 are formed in regions protruding inwards such that these regions contact the burner port assembly's 3 outer wall. Therefore, a sideways tributary diverted through said opening 35 from the vertical course of thick gas mixture will directly enter the corresponding larger opening 62*b* so as to be jetted from collateral burner port 61*b*.

Sideways tributaries through the other communicating openings 33 will take a route different from that which the tributaries through the former openings 35. As seen in FIG. 18*b*, that is the cross section taken along the line B—B in FIG. 15, the other communicating openings 33 in principal part 5 are round holes formed in the protuberances 31 thereof. These openings 33 face the smaller upper recesses 56*a* formed in the outer wall segments of burner port assembly 3. Also, these round openings 33 underlie each band 58, and particularly face the smaller opened regions 62*a* of said upper recesses 56*a*.

It is however noted that, in contrast with the larger openings 35, these smaller openings 33 are formed in the recessed regions (seen from inside) 31. Consequently, there is a certain gap between each smaller opening 33 and the side face of burner port assembly 3, nevertheless the smaller opening 62*a* being pointed to such a smaller communicating opening. As a result, a fine tributary from each smaller opening 33 is not likely to wholly enter the corresponding opening 62*a* to be jetted from collateral burner port 61*b*, but a considerable part or the remainder of this tributary will be spouted into the intermediate burner port 78. The corresponding one of communicating openings 74 connecting the inside of each main burner port 53 to the outside thereof in fluid communication will function to flow a small amount of thin gas mixture sideways into the intermediate burner port 78. In this way, the remainder of said tributary will be diluted to an intermediate level of gas concentration.

In this connection, FIG. 18*c* as the cross section taken along line C—C in FIG. 15 may be referred to here. It will be apparent there that the communicating openings 74 causing the inside of each main burner port 53 to communicate with the outside are formed in the outer burner port wall segments 52*a* and 52*f*. The openings 74 are in a direct communication with the intermediate burner ports 78. The thin gas coming through these openings 74 sideways from the main burner port 53 will be intermixed with the thick gas in the intermediate burner ports 78. This thick gas comes through the other communicating openings 33 sideways from the spaces 63 as auxiliary burner ports 63, so that such a mutual intermixing of the gasses is effected within said intermediate burner ports 78 and jetted from the burner ports 78.

Now returning to the description of the blending station 70 (see FIG. 16), a part of the thick gas mixture well homogenized in this station 70 composed of the spaces 67 and 68 will flow out through the constricted canal 72 as detailed above. The remainder of such a thick gas mixture will flow into the space 68 (as a region of thick gas passage 73) surrounding the venturi 23 (as a part of thin gas passage 22). Consequently, the said remainder of thick gas mixture will flow into venturi 23 through the supplementary gas openings 29 thereof. The thus flowing into the thin gas passage 22 is to have entered the principal part 5 of the burner body.

It will be understood that due to presence of such a throttled region in the thin gas passage 22 where those supplementary openings 29 are formed, the thin gas mixture increases its velocity at this region to thereby produce a negative pressure. On the other hand, the space 68, a part of thick gas passage, filled with thick gas mixture and surrounding the venturi 23 is of a normal pressure, so that the internal negative pressure appearing in venturi 23 allows a part of the external gas mixture to be sucked into venturi. The thick gas passage 73 formed around the vanturi 23 is sealed with ribs 14. Any part of thick gas mixture can however not leak in between the principal and supplementary parts of the burner body. Thus, the thick gas mixture is sucked into the venturi 23 through its openings 29 at any predetermined desirable rate. The thick gas mixture fine streams collide at a right angle with the air stream flowing through the thin gas passage 22, so as to be blended well with air to produce a thin gas mixture.

This thin gas mixture will then advance to the thin gas mixing chamber 25 and sharply turn its flow direction, while being mixed and agitated further. The thin gas mixture subsequently flowing through the communication channel 26 will arrive at the burner port holder 27 to finally enter the burner port assembly 3. The major part of the thin gas mixture thus fed to this assembly 3 will jetted out from the main burner ports 53 to generate fire flames. The remainder of this mixture having entered said assembly 3 will transfer to the intermediate burner ports 78 through the communicating opening 74 of burner port wall segments 52*a* and 52*f*. Such a remainder is intermixed with the thick gas mixture that is flowing into the burner ports 78 through the openings 33 in the described manner, before jetted out these burner ports.

It will now be apparent that the thick and thin gas mixtures having taken the described respective routes will be blown out from the main burner ports 53, collateral burner ports 61*a* and 61*b*, auxiliary burner ports 63 and intermediate burner ports 78. The igniter 81 overlying the apparatus 1 will produce electric sparks between it and the tie portions 59 so as to inflame these gas mixture tributaries to generate fire flames. Comparatively large (main) flames of thin gas will arise from the main burner ports 53, and smaller (auxiliary) flames of thick gas will arise from the auxiliary burner ports 63 disposed beside the main burner ports 53. Also, additional smaller (collateral) flames of thick gas (coming through openings 33 and 35) will arise from the collateral burner ports 61*a* and 61*b* disposed beside the auxiliary burner ports 63. Further (intermediate) flames of the intermediate concentration gas will arise from intermediate burner ports 78, between the each main flame and the adjacent collateral flame, and also between the adjacent auxiliary flames.

The major part of thick gas fed to the auxiliary burner ports 63 will be thoroughly burnt to ensure complete combustion, whereby smaller but steadier auxiliary flames are produced in proximity of the main flames of thin gas from the main burner ports 53. The minor part of thick gas fed to the collateral auxiliary burner ports 61*a* and 61*b* will also be thoroughly burnt to ensure complete combustion, whereby additional and steadier collateral flames are produced in proximity of the main burner ports 53. Further the intermediate concentration gas will produce the intermediate flames from the intermediate burner ports 78. It is a surprising feature of the present combustion apparatus 1 that the basal portions of main flames being produced with thin gas at the main burner ports 53 do desirably receive a sufficient amount of heat from all the neighboring smaller flames from the auxiliary, collateral and intermediate burner ports 78. Thus, those main flames are now stabilized well to resolve the problems of pulsating combustion and noise-generating combustion.

Main burner ports 53, collateral burner ports 61*a* and 61*b*, auxiliary burner ports 63 and intermediate burner ports 78 cooperate with each other to almost completely burn the fuel gas fed to the apparatus 1. Generation of toxic gases such as carbon monoxide and the like materials is diminished in this combustion apparatus, lest the environment should be contaminated with such toxic or hazardous materials. Efficiency of heat is also improved herein, and thus any desired and calculated quantity of heat energy can now be produced accurately, thanks to extremely reduced amount of unconsumed raw gas discharged from this apparatus. The combustion apparatus of the invention, which does no longer emit the toxic gas or raw gas, will protect ambient people from any bad smell, the irritation of their eyes or the like unpleasant feeling.

Flame stabilizer 60 formed in the apparatus 1 as protuberances from the burner port wall segments 52*a* and 52*f* will contribute to an increased heat capacity of the main burner ports 53 defined with these segments. If a user operates to lower the force of fire flames, letting them to make approaches to the main burner ports, the increased heat capacity thereof will prevent super-heat of said burner ports. Any serious or violent operation of the combustion apparatus 1 of the invention will not cause any the rmal deformation thereof, and thus the 'turndown ratio' (TDR) can now be made higher as compared with the prior art apparatuses.

Since superheat of the main burner ports 53 does not take place, despite the flames' approaches thereto, it is now possible to render the combustion apparatus 1 more compact and smaller in size.

Tie portions 59, provided at the nodes 54 present between main burner ports 53 as shown in FIG. 11, are used as the targets for sparks from the ignition plug 81. Thus, fuel gas mixture will surely inflamed, even if any unintentional and wrong relationship in position is involved between the igniter 91 and the apparatus 1.

Alternative locations of the tie portions 59 disposed at the nodes 54 in the described embodiment are upper end areas of the principal and supplementary parts 5 and 6, the proximity of main burner ports 53, collateral burner ports 61*a* and 61*b*, auxiliary burner ports 63 or the like flame jetting portions. Further and preferably, additional tie portions 59 may also be incorporated in the apparatus, because the igniter 81 at any slightly incorrect position will still be able to throw sparks to the primary tie portions 59 and/or such additional tie portions.

As described above, the ribs 14 are made by simultaneously caulking both the fragments 25*a* of thin gas mixing chamber 25 and the recessed fragments 40*b*, after having stacked the principal part 5 on supplementary part 6. Thus, it is an important feature that the thick gas passage 73 is stopped at its region downstream of the venturi 23 by means of such a rib 14. This rib 14 will not permit any amount of the gas mixture to leak in between those parts 5 and 6, but force it only into the supplementary gas openings 29. Therefore, gas concentration of the mixture being emitted from the main burner ports 53 will never fluctuate from time to time. By virtue of this feature, combustion of the gas mixture stands stable all time long of operation of the apparatus.

Figure 7:
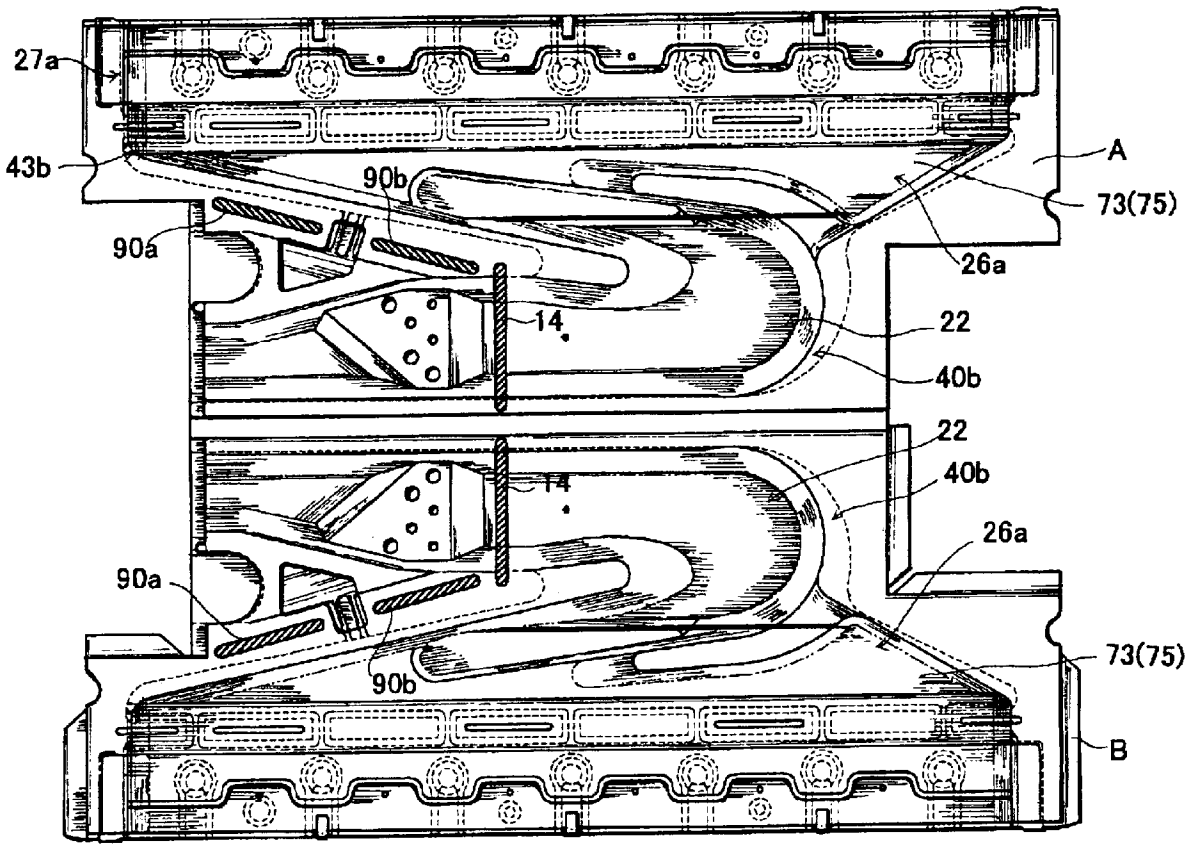
FIG. 7 is a front elevation corresponding to FIG. 5 and showing a further embodiment of the invention.

It is possible to provide the apparatus 1 with further ribs 14 such as 90*a* and 90*b*, in addition to the rib 14 that is disposed downstreamly of the venturi 23 as shown in FIG. 7. Each additional rib 90*a* and 90*b* may be formed by pressing the portion of tie walls 19*a* of the part 5 towards and together with the other portion of intermediate contact fragments 45*a* of the other part 6. In this case, the thick gas mixture flowing through the oblique groove 45 will more surely be inhibited from leaking outwards in between the parts 5 and 6, so as to reliably supply the gas passage 73 with the mixture at a designed accurate rate. Fuel concentration in the gas mixtures forwarded to the respective burner ports 53, 61, 63 and 78 will be rendered more stable, thereby enabling much steadier combustion.

Figure 19:
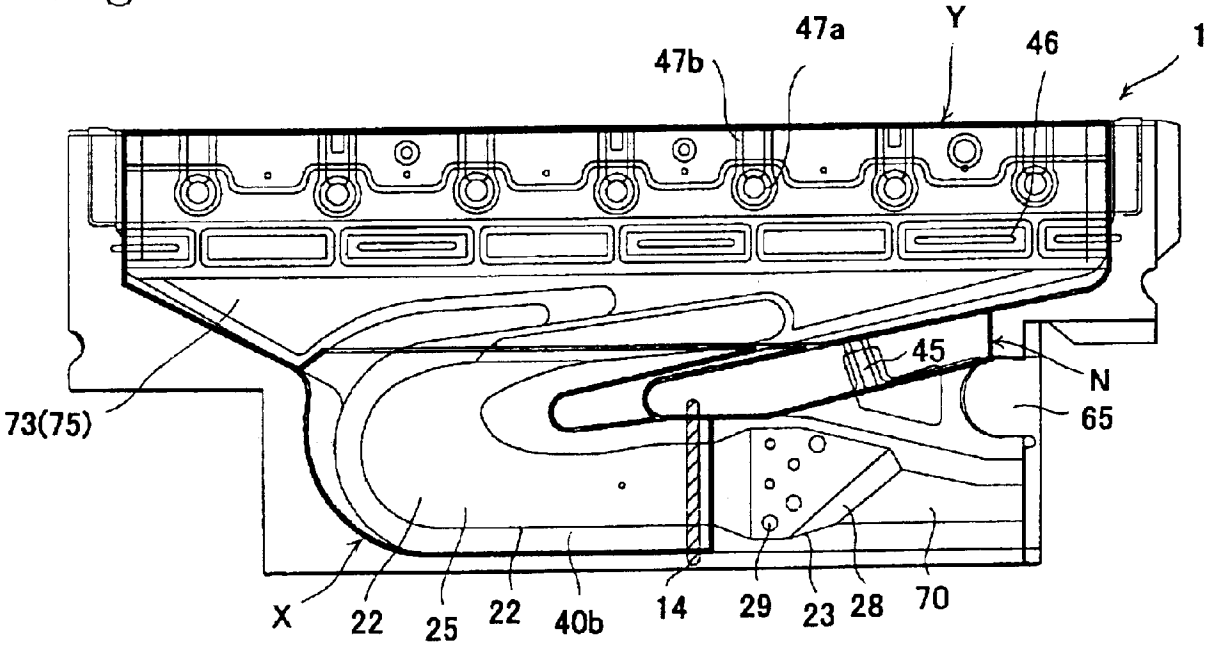
FIG. 19 is a front elevation of the apparatus shown in FIG. 1.
Figure 20:
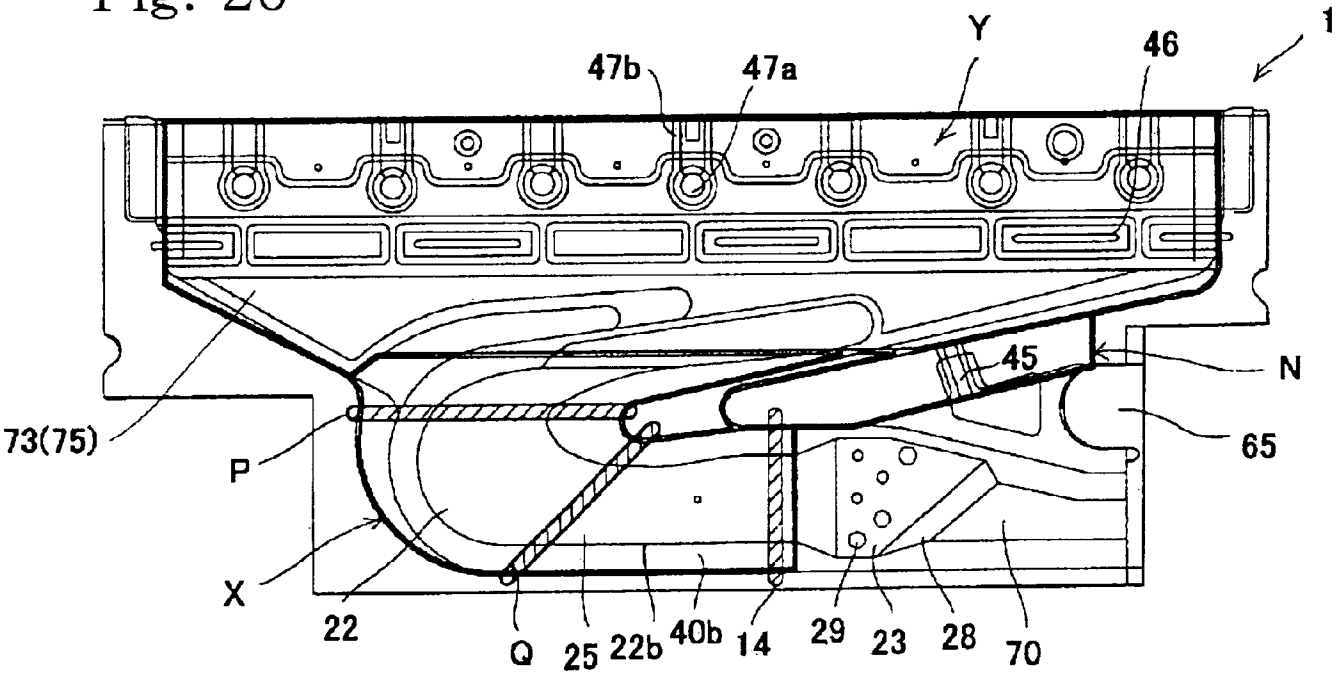
FIG. 20 is a front elevation corresponding to FIG. 19 and showing a still further embodiment of the invention.

Some complementary descriptions will now be given as to the rib 14, for the sake of better understanding thereof. The four constituent plates 7, 8, 10 and 11 are prepared each by pressing a metal plate to have therein protruding and depressed regions, which are however difficult to be of accurate shape and dimension. Some undesirable interstices are prone to be produced between the adjacent pressed regions. If some amount of gas mixture enters such interstices between the principal and supplementary parts 5 and 6, then fuel concentration will fluctuate in the gas mixtures being jetted from the burner ports and combustion will become unstable. In order to prevent any unwanted leakage into those interstices, the rib 14 in this embodiment is formed in the area 'X' indicated in FIG. 19 so as to be disposed near the venturi 23 and downstreamly of gas mixture flow.

Thin gas mixing fragments 25*a* (as the depressed regions of plate 7 and 8) and the recessed fragments 40*b* (as the depressed regions of plate 10 and 11) are laid one on another to define the area 'X'. This area 'X' defines a downstream region of venturi 23. At this venturi 23, the thin gas passage 22 (principal passage) for the main burner ports 53 is diverged from the thick gas passage 73 (supplementary passage) for auxiliary burner ports 63. The area 'X' intervenes between the blending station 70 and another area 'Y' (where the thin and thick gas mixtures coexist) also shown in FIG. 19.

At the another area 'Y', each of the main plates 7 and 8 has its communicating fragment 26*a* and burner port holding fragment 27*a*, both being laid on the corresponding plate 10 or 11 at its bulged gas passage fragment 43*b*. Such another area 'Y' is thus located at the downstream side of the first mentioned area 'X' and the venturi 23, with respect to the flow of gas mixtures.

Supplementary gas-feeding openings 29 formed in venturi 23 allow a part of the fuel gas to enter the thin gas passage 22 at a designed flow rate. This rate decides the ratio in fuel concentration of the thin gas mixture to the thick gas mixture flowing through expanded canal 75 of the other passage 73. In view of this fact, the rib 14 at area 'X' is intended to prevent gas leakage in between the parts 5 and 6 downstreamly of the blending station 70. A precise rate of the fuel gas into the thin passage 22 will thus afford a constant ratio of fuel concentration for all the burner ports to stabilize combustion.

It is further noted that in the present embodiment the rib 14 substantially completely surrounding the thin gas passage 22 is located at the most upstream region of the area 'X'.

The rib 14 located nearest the blending station 70 will diminish variation in effective volume of this station 70.

Further, the rib 14 encircling the passage 22 will surely inhibit gas leakage therefrom.

However in the this invention, the rib may alternatively be disposed at a point 'P' nearest the downstream end of the area 'X', or at another point 'Q' that is a middle point of this area.

It will now be apparent that such a rib 14 disposed in the area 'X' is useful to avoid gas leakage from between the thin gas mixing fragments 25*a* and recessed fragments 40*b* laid thereon. However, attention may be paid to a further area 'N', in which the constituent parts 5 and 6 are also disposed close to each other and only the thick gas mixture exists. This area 'N' defined between the blending station 70 and another area 'Y' shown in FIG. 19 may include an additional rib or ribs. The purpose of incorporation of such additional ribs is to ensure fluid tightness between the parts 5 and gas, so as to afford a more constant ratio in fuel concentration of one stream to the others, ensuring much steadier combustion.

The groove 45 formed in the further area 'N' and spanned between the blending station 70 and the last mentioned area 'Y' serves to connect the former to the latter in fluid communication. Flat portions of those parts 5 and 6 are in close contact with each other in the secondly mentioned area 'N'. Although the spot welding of these portions may somewhat be useful to make airtight the groove 45 against the neighboring regions, it is more preferable to form additional ribs 90*a* and 90*b* similar to the first mentioned rib 14, as shown in FIG. 7.

It is to be noted in this connection that fuel concentration of the thin and thick gas mixtures respectively flowing through the passages 22 and 73 (its expanded canal 75) depends on the overall feed rate of the fuel gas at the fuel intake, on one hand. The fuel concentration will depend also on the flow rates of gas mixtures flowing through their passages, on the other hand. Therefore, not only the gas mixture inflow to the thin gas passage 22, but also the other inflow to the thick gas passage 73, has to be controlled as accurately as possible.

To meet this requirement, the principal part 5 must airtightly contact the supplementary part 6 in the area 'N' in order to feed the gas mixture into the expanded canal 75 at such an accurate rate. If there is present a gap, large or small, between those parts, then a part of fuel gas outflow from the station 70 to canal 45 will escape into the gap, which cause fluctuation of the concentration of thin gas. The ribs 90*a* and 90*b* formed beside the groove 45 within the area 'N' will prevent such an escape of fuel gas into the gap, to thereby supply a stable gas mixture flow of constant concentration to the canal 75. Owing to the structural features described above, all the burner ports 53, 61, 63 and 78 can receive steady tributaries of constant fuel concentration to ensure stable combustion.

Figure 21:
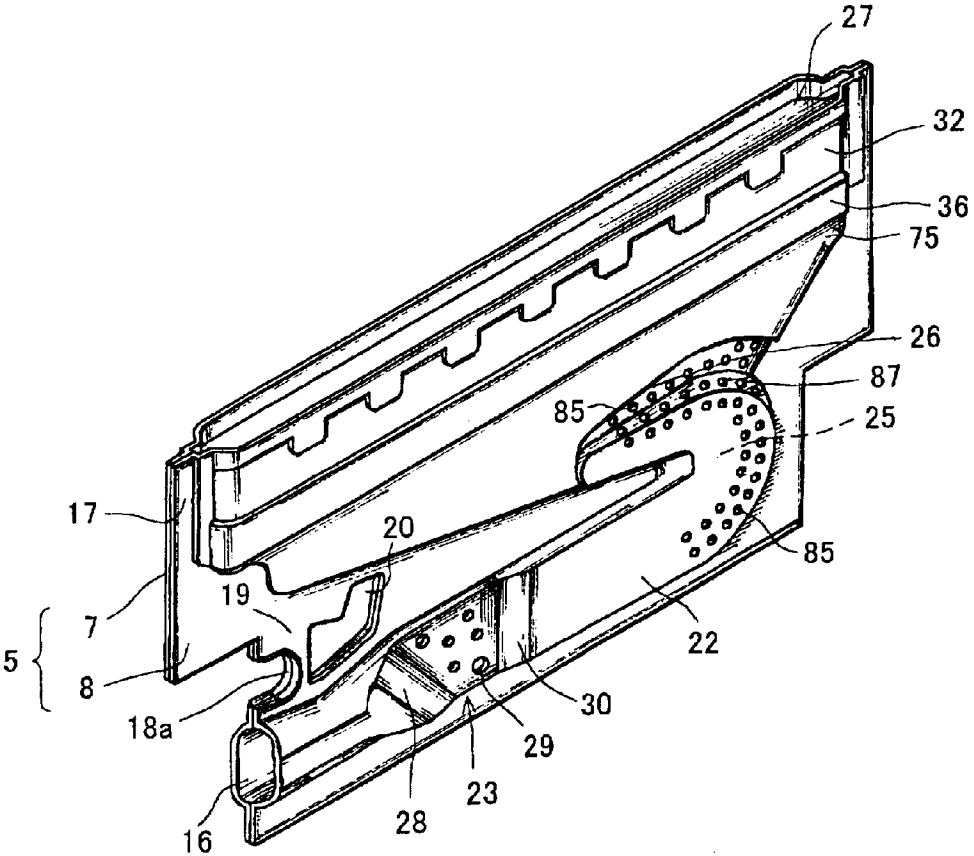
FIG. 21 is a perspective view of a modified main body incorporated in the apparatus shown in FIG. 1.

The combustion apparatus of the described embodiment is a mere example of the present invention. Therefore, it may be modified in any manner as illustrated in FIGS. 21 and 22 to comprise certain lugs 85 and/or 86. This apparatus is almost the same in structure as the apparatus provided in the first embodiment, except for these lugs 85 and 86 that improve the thin gas passage 22. Preferably, a number of the lugs 85 facing the centerline of this passage 22 may be disposed on the wall portion at the thin gas mixing chamber (viz., flow passage deflector) 25 where the gas mixture stream will sharply change its flow direction.

Figure 23A:
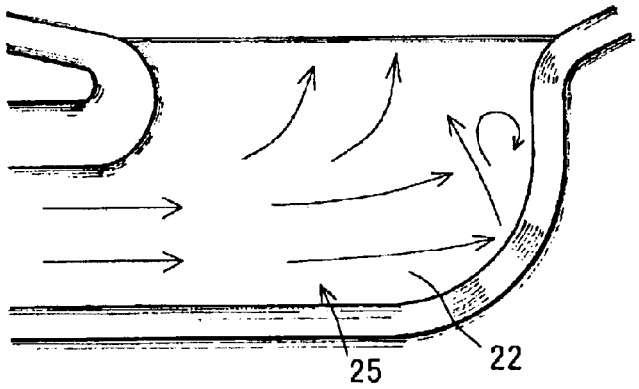
FIG. 23*a* is a scheme illustrating the flow of a gas mixture through a deflecting region that is included in the gas passage in the apparatus shown in FIG. 1, wherein no lugs are formed in the wall of the deflecting region.

It is supposed that the thin gas mixture from the upstream region of said passage 22 will collide with the sharply curved inner wall surface of the mixing chamber 25, to thereby making a backlash and/or generating a huge eddy (see FIG. 23*a*). In contrast with such a natural condition of flow, those small lugs 85 will generate around them a number of extremely fine eddies. Thus, neither backlash nor large eddy will be generated in the gas mixture stream, but it flows smoothly along the curved wall without emitting any noise, while being equalized in pressure.

Figure 23B:
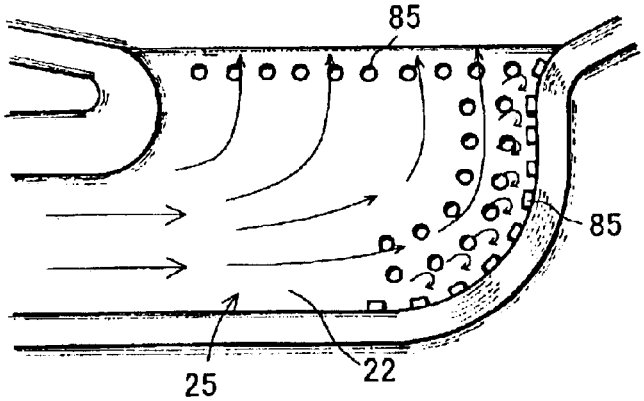
FIG. 23*b* is a scheme corresponding to FIG. 23*a*, but showing a case wherein a number of lugs are formed in the wall of the deflecting region.
Figure 23C:
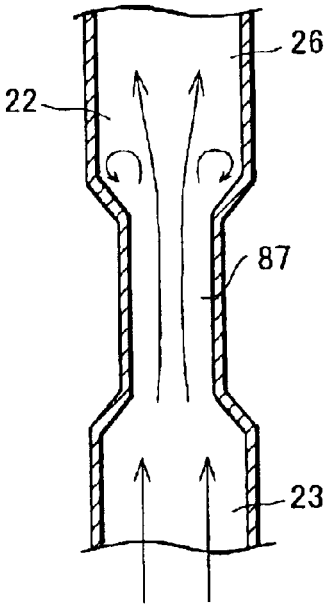
FIG. 23*c* is a scheme illustrating the flow of the gas mixture through a constricted section that is included in the gas passage formed in the apparatus shown in FIG. 1, wherein no lugs are formed in the wall of the constricted section.
Figure 23D:
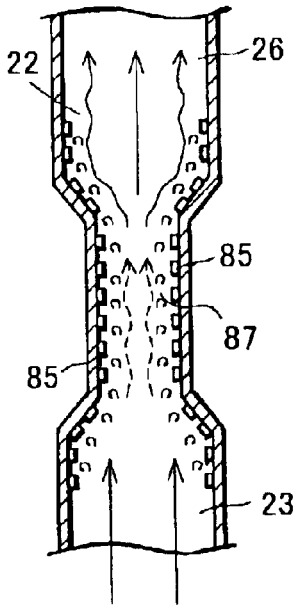
FIG. 23*d* is a scheme corresponding to FIG. 23*c*, but showing a case wherein a number of lugs are formed in the wall of the constricted section.

The thin gas mixing chamber 25 continues to the communication channel 26, via a throttle 87 (see FIG. 21). At this throttle 87, the cross-sectional area of gas mixture passage will restore its dimension, after having reduced it at first as shown in FIG. 23*c*. It is supposed that the gas mixture flow delivered from the mixing chamber 25 and having passed the throttle 87 at an accelerated flow speed will have its outer annular stratum tending to remove away from the inner periphery of the expanded region, thereby hardly generating huge eddies. If however a number of the lugs 85 similar to those shown in FIG. 23*b* are formed on said inner periphery as shown in FIG. 23*d*, then those small lugs 85 will generate around them a number of extremely fine eddies. Any huge eddy will no longer be generated in the air or gas mixture just passing through the throttle 87, but they flow smoothly along the peripheral wall without emitting any noise, while becoming uniform in pressure.

Figure 22A:
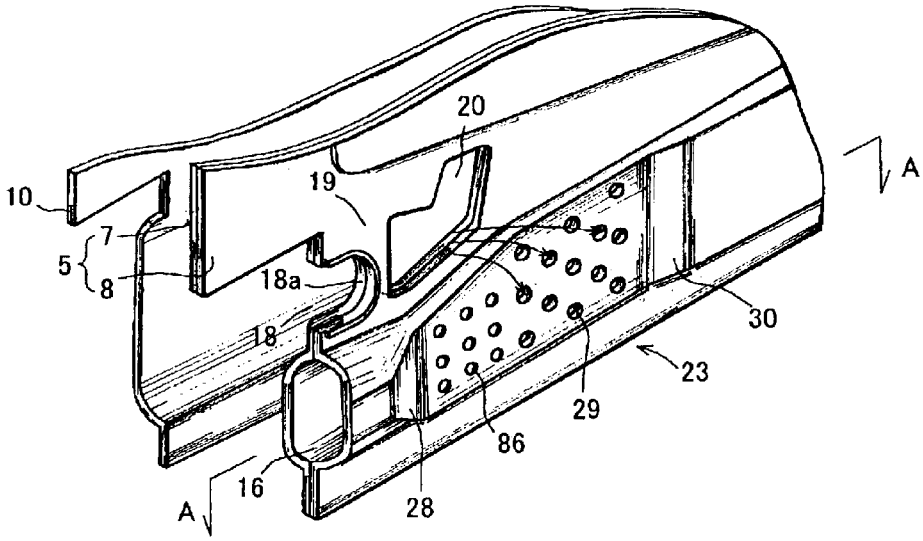
FIG. 22*a* is an enlarged fragmentary perspective view of a venturi portion forming a further modified main body incorporated in the apparatus shown in FIG. 1.
Figure 22B:
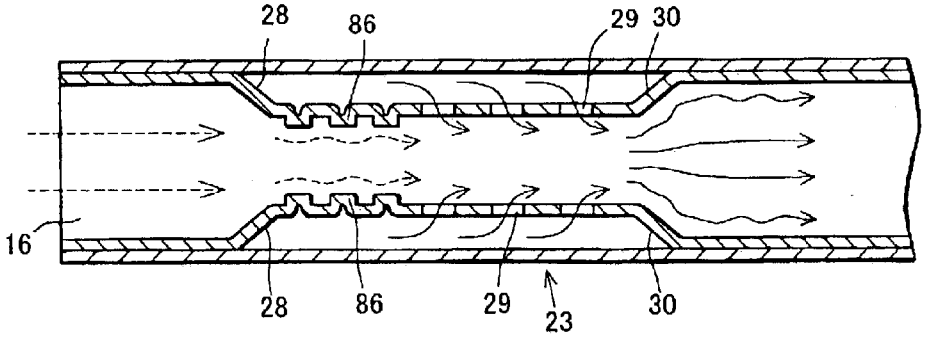
FIG. 22*b* is a cross section taken along the line A—A in FIG. 22*a;*

FIGS. 22*a* and 22*b* show a differently modified example of the principal part 5, wherein a number of or several lugs 86 are formed on the inner periphery of an upstream region of venturi 23. This region of the thin gas passage 22 is located near and downstreamly of the air intake 16 for receiving air or thin gas, but upstreamly of the supplementary gas-feeding openings 29 formed in said venturi 23. Portions of air or the thin gas will impinge on those lugs 86 to thereby generate fine eddies close to the inner to periphery, and flow down further to be intermixed with the thick gas mixture from the feeding openings 29. Similarly to the throttle 87 shown in FIG. 23*d*, the air or thin gas stream will thereafter pass through the succeeding expanded region of passage, also together with the fine eddies and along the peripheral wall of this region. Any huge eddy will no longer be generated in the air or gas mixture just passing through the portion which the cross-sectional area expands in the downstreamly of venturi 23, but they flow smoothly along the internal surface.

Thanks to such lugs 86 near the air intake 16, any huge eddy will no longer be generated in the air or gas mixture flowing through the venturi 23. Subsequently, they will continue to flow smoothly in a laminar state along the peripheral wall without emitting any noise, while becoming uniform in pressure to stabilize the flames.

The lugs 85 and 86, that are short columnar protrusions facing the centerline of thin gas mixture passage 22, will be formed by pressing the metal plates 7 and 8. Each lug may have a diameter of about 2 to 8 mm, and s height of 1 mm or less.

The lugs 86 are disposed upstreamy of the supplementary gas-feeding openings 29 in the case shown in FIGS. 22*a* and 22*b*, though they may be formed near the protuberance 31 or downstreamly of them 29.

Figure 24A:
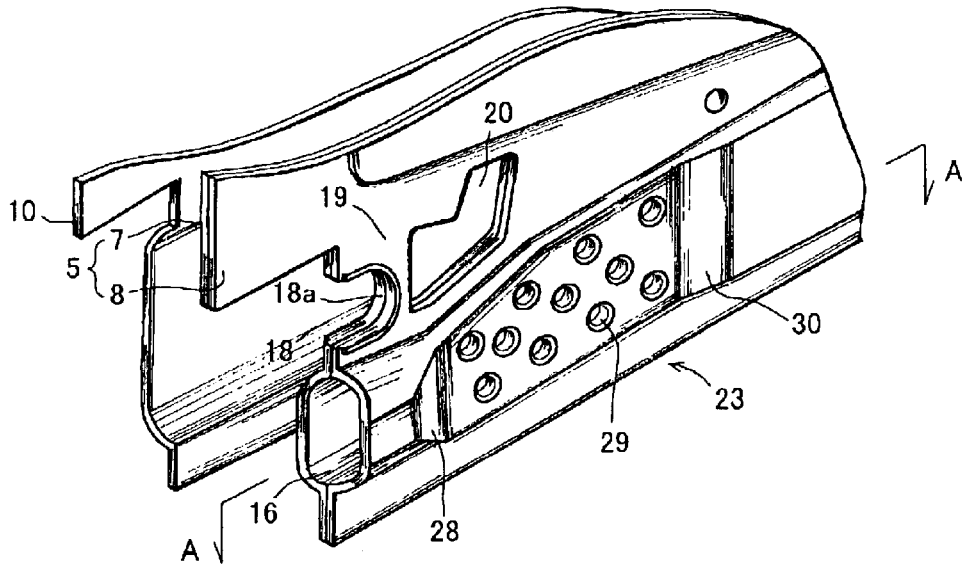
FIG. 24*a* is an enlarged fragmentary perspective view of a modified venturi portion incorporated in the apparatus of the invention.
Figure 24B:
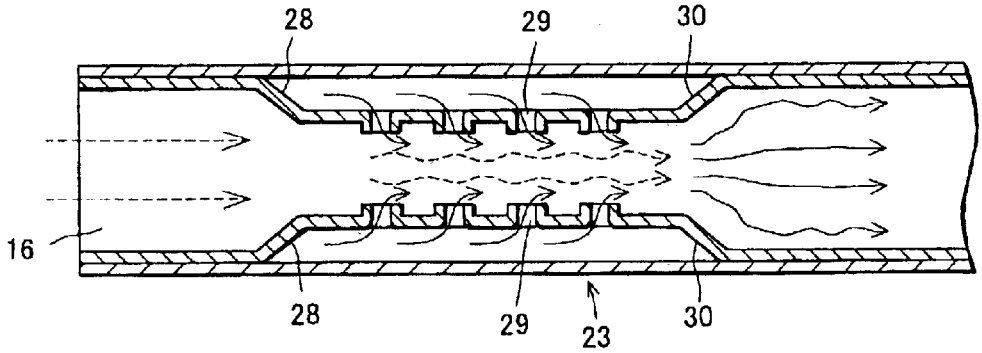
FIG. 24*b* is a cross section taken along the line A—A in FIG. 24*a;*

The lugs 86 are exemplified as solid columnar protrusions located upstremaly of the gas-feeding supplementary openings 29. However, they may alternatively be round openings each having a rim burred inwards toward said center line of passage 22 as shown in FIGS. 24*a* and 24*b*. Portions of air or the thin gas will impinge on those burred rims of openings 29, in this case, to thereby generate fine eddies close to the inner periphery, similarly to the principal part 5 shown in FIGS. 22*a* and 22*b*. They will flow down further to be intermixed with the thick gas mixture from the feeding openings 29. Also in this case, the air or thin gas stream will thereafter pass through the succeeding expanded region of passage, also together with the fine eddies and along the peripheral wall of this region, without emitting any noise, while becoming uniform in pressure.

Although the burred openings 29 shown in FIGS. 24*a* and 24*b* substitute for the lugs 86 shown in FIGS. 22*a* and 22*b*, such burred openings 29 may be employed in addition to the lugs 86. In the preceding modifications shown in FIGS. 21 to 24*b*, lugs are formed in a region of the thin gas passage 22 or in the supplementary gas-feeding openings 29 opened there in. However, those lugs or the like may be provided in the thick gas mixture passage 73 in the present invention.

Figure 25A:
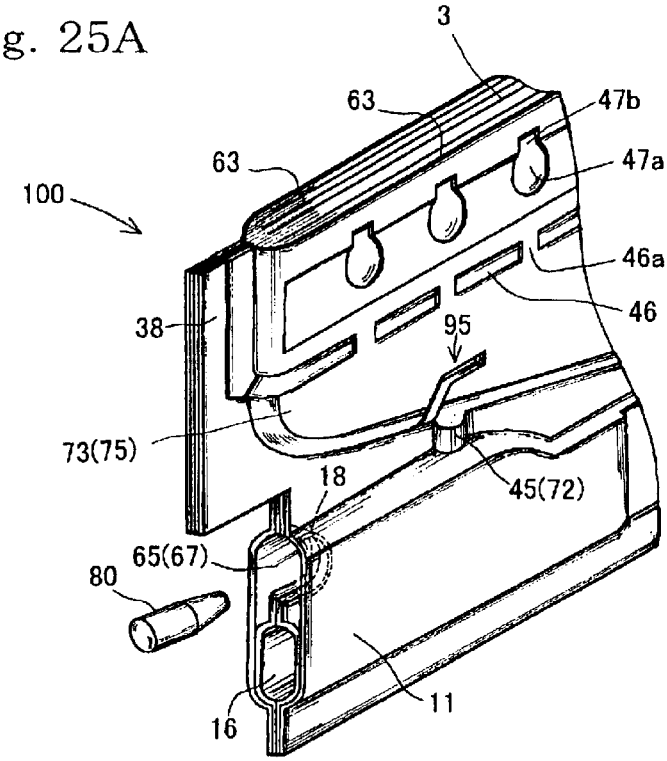
FIG. 25*a* is a perspective view of a blending station that is formed in the apparatus according to a yet still further embodiment.
Figure 25B:
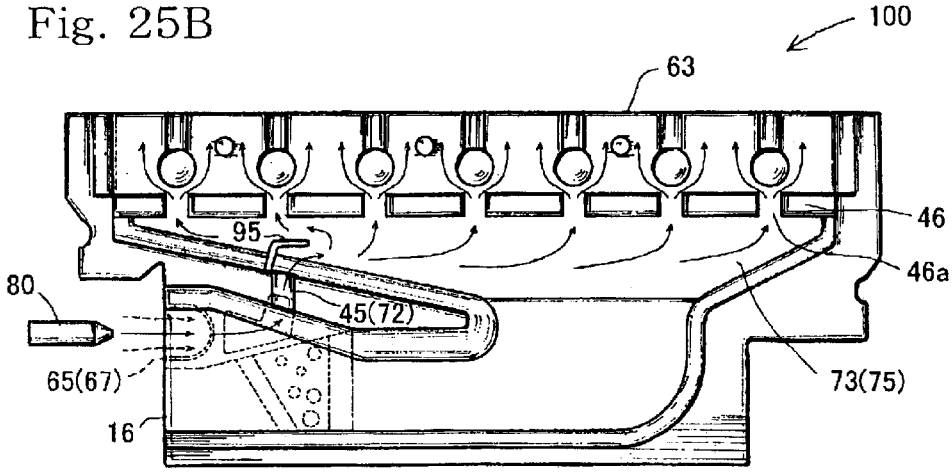
FIG. 25*b* is a scheme showing the flow of the gas mixture in and through a thick gas passage of the apparatus shown in FIG. 25*a;*
Figure 26A:
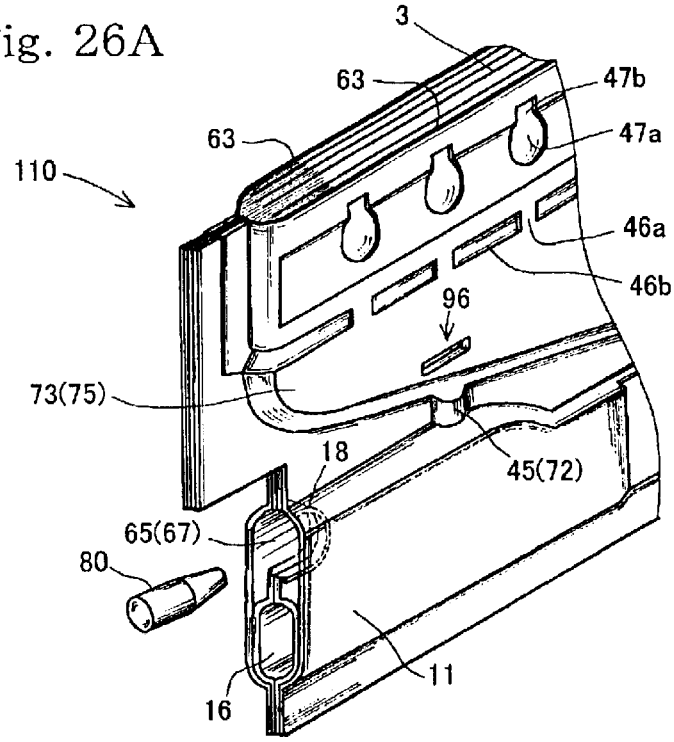
FIG. 26*a* is a perspective view of the blending station that is formed in the apparatus according to another embodiment.
Figure 26B:
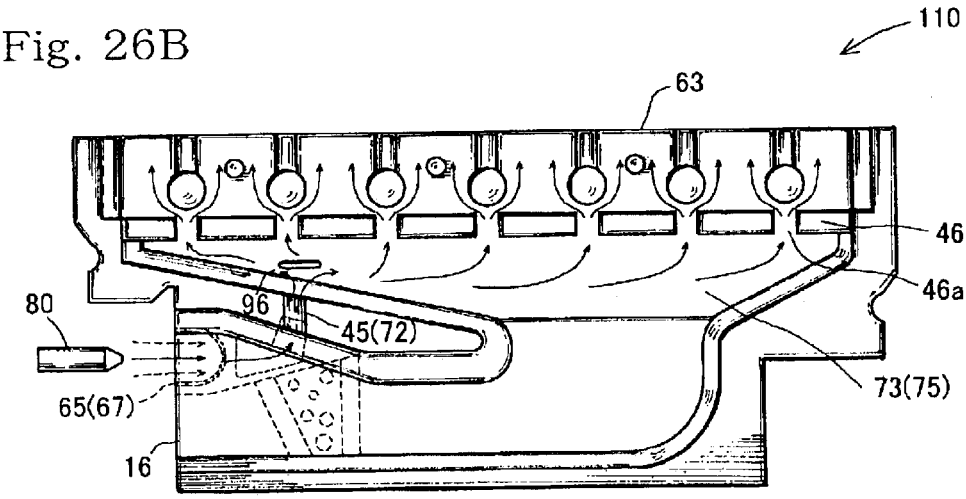
FIG. 26*b* is a scheme showing the flow of the gas mixture in and through the thick gas passage of the apparatus shown in FIG. 26*a;*

In the apparatus 1 described above, the constricted canal 72 is opened to face the center of expanded canal 75 of the thick gas mixture passage 73 so as to uniformly distribute the thick gas towards all over each array of auxiliary burner ports 63. FIGS. 25*a* and 25*b* as well as FIGS. 26*a* and 26*b* show alternative examples 100 and 110 of combustion apparatus of the invention. Each of them 100 and 110 are of generally of the same structure as the first described apparatus 1, except for a deflector 95 or 96 that is disposed above the constricted canal 72 and thus downstreamly of the thick gas mixture flow. In this case, each supplementary plate 10 and 11 has a portion deformed to provide such a deflector 95 or 96 adjacent to the outlet of said canal 72.

Such a deflector will be useful to detour any difficulty which the pressing of metal plates or the designing of constituent parts would sometimes encounter in forming the inclined constricted canal 72 facing the center of expanded canal 75. It may also be possible to employ such a deflector 95 or 96 in addition to the inclined constricted canal 72 for the thick gas as in the embodiments first described above. In this case, a much more uniform distribution of concentration of the fuel gas will be achieved in the gas mixture being jetted from the auxiliary burner ports, thus stabilizing the flames produced thereby.

In every case discussed above, the angle of constricted canal 72 or the angle of a gas mixture jet therefrom is adjusted to afford a uniform and optimal jet of thick gas from all the unit auxiliary burner ports 63. The present invention is not delimited to such a mode, but may be modified in a fashion shown in FIG. 27 to give an apparatus 120. In this embodiment, gaps each present between two neighboring unit dams 46 is varied orderly along an array thereof so as to give a series of inter-dam canals 46*a*. The shorter the distance from inter-dam canal to the exit of constricted canal 72, the narrower will be the gap to decrease cross-sectional area thereof and to thereby increase friction against the corresponding tributary of gas mixture flow.

According to this structure of the apparatus, the inter-dam canals 46*a* more remote from the constricted canal 72 are less resistant to the flow of tributaries than the other inter-dam canals 46*a*. Respective tributaries can flow through the respective inter-dam canals 46*a* almost at the same rate. Thus, the fuel gas will be distributed substantially uniformly to all the inter-dam canals, improving inflammability of fuel gas mixture as a whole to be simultaneously burnt at the auxiliary burner ports and stability of main flames assisted with auxiliary flames.

For the combustion apparatus 120 of this embodiment, adjustment of the cross-sectional area of each inter-dam canal 46*a* is done taking into account the direction in which the gas mixture is jetted from the exit of constricted canal 72. This principle is also useful to other types of combustion apparatus in which the constricted canal 72 is replaced by certain openings as branched canals. For example, the other type apparatus may comprise the upper and lower space 71 and 67 (see FIG. 17*b*) separated by a partition. This partition is composed of outward protuberances formed on the outer face of each principal plate 7 and 8, wherein several openings as the branched canals will be formed in and through the partition. In this way, the structure including such branched canals can be designed easily to supply through and beyond said space 71 the respective auxiliary burner ports with the gas mixture substantially at the same rate.

Figure 28:
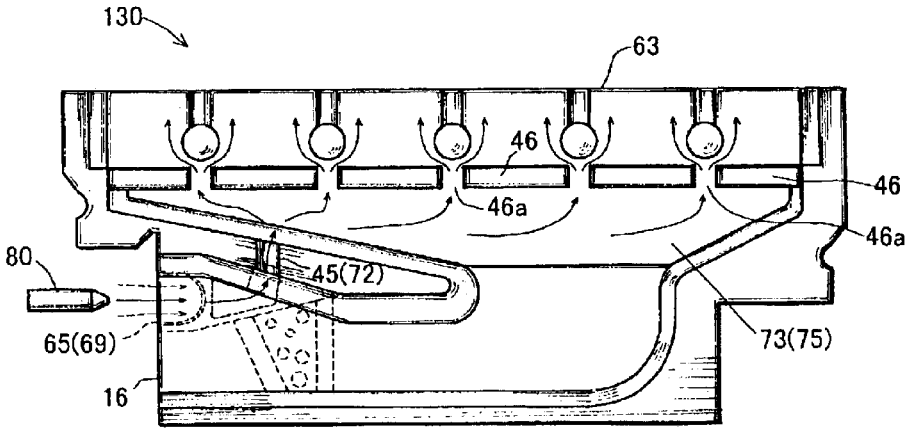
FIG. 28 is a scheme corresponding to FIG. 27 but showing the flow of the gas mixture in and through a further modified thick gas passage.

FIG. 28 shows a combustion apparatus 130 in a further embodiment, in which the thick gas mixture as indicated in this figure.

Figure 27:
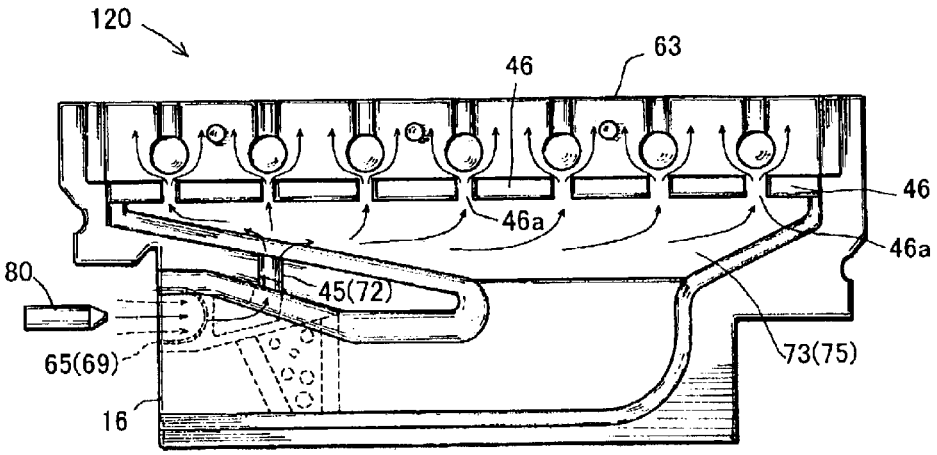
FIG. 27 is a scheme showing the flow of the gas mixture in and through a modified thick gas passage.

Similarly to the apparatus 120 shown in FIG. 27, also the constricted canal 72 in this apparatus 130 does extend vertically. However it will be seen in FIG. 28 that neither deflectors 95 or 96 nor inter-dam canals 46*a* of varied cross-sectional areas are employed, unlike the other apparatuses 100 and 110 summarized above.

Constricted canal 72 of this apparatus 130 has its centerline, whose extrapolation intersects with the center of one of the dams 46. In other words, such an extrapolation extends amid between the two adjacent 46*a* and 46*a*. Such an arrangement of constricted canal 72 and inter-dam canals 46*a* is employed herein, lest the gas mixture from this canal 72 should directly and straightly enter any of the inter-dam canals.

An upward outflow from the constricted canal 72 will selectively impinge only on the said one dam 46. This outflow is then deflected sideways and in opposite directions toward the respective inter-dam canals 46*a*, so as to feed them the mixture generally at the same rate. Also in this case, the gas mixture will be distributed evenly to the auxiliary burner ports 63, over the full length of its array.

Figure 29:
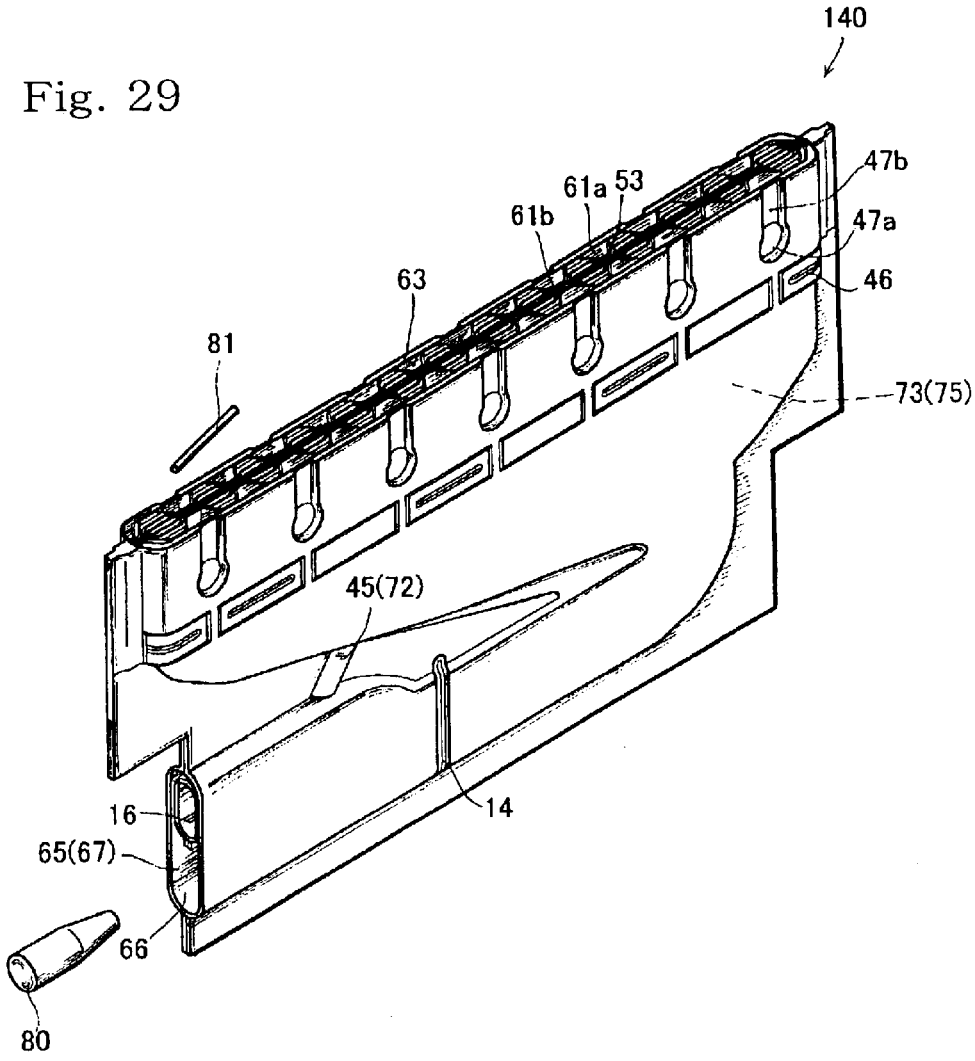
FIG. 29 is a perspective view of the combustion apparatus according to still another embodiment.
Figure 30:
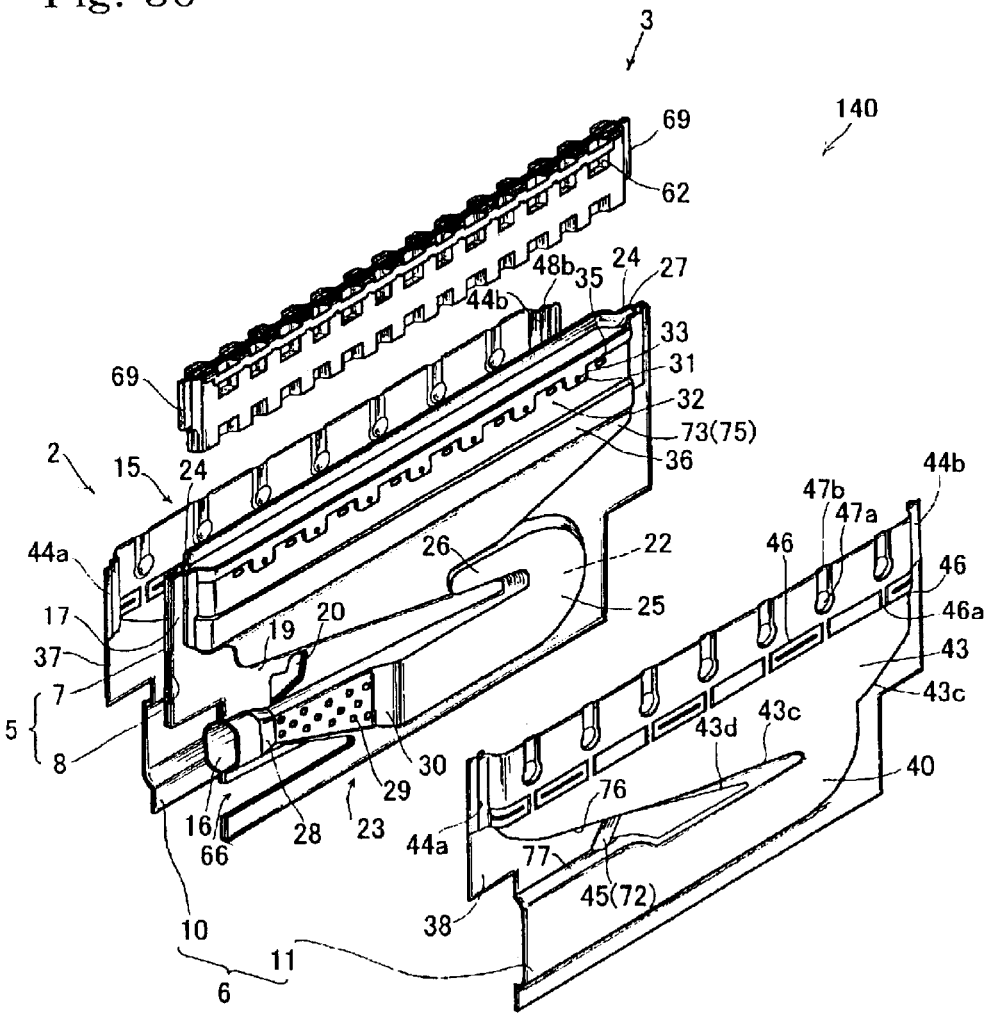
FIG. 30 is an exploded perspective view of the combustion apparatus shown in FIG. 29.
Figure 31:
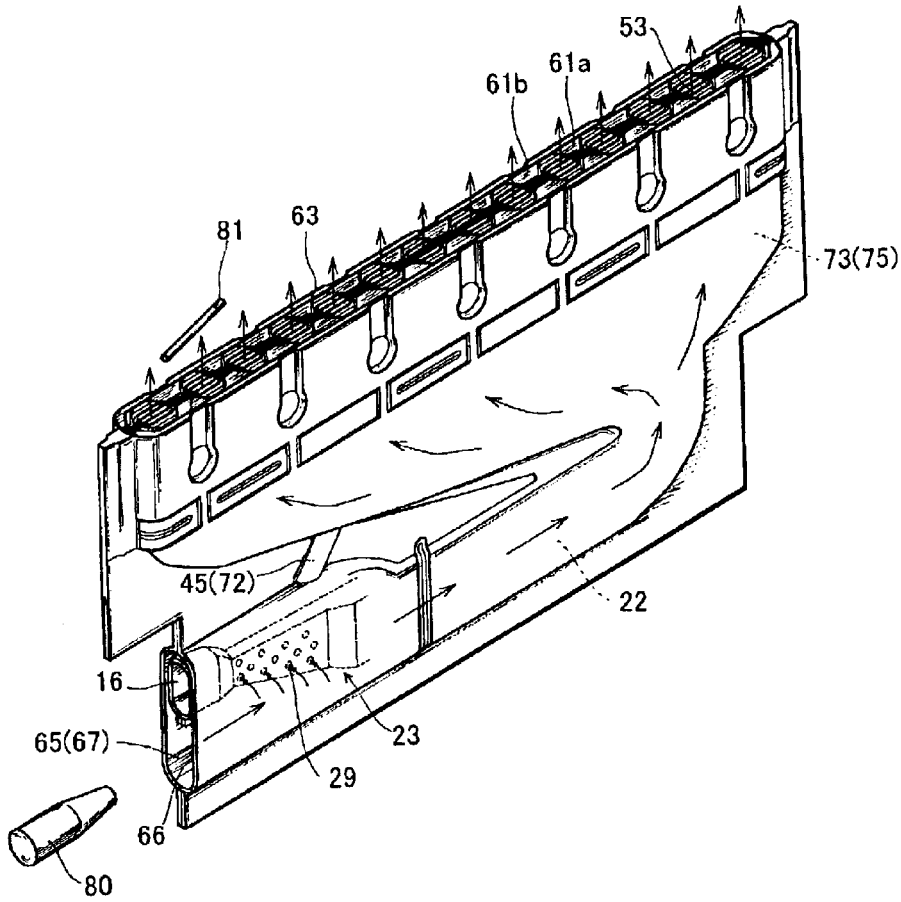
FIG. 31 is a scheme of the flow of a fuel gas mixture being jetted from main burner ports that the apparatus shown in FIG. 29 comprises.

The combustion apparatus of the invention may be modified in still another manner. For example, the apparatus 140 shown in FIGS. 29 and 30 comprises the air intake 16 and the fuel intake 66 that are arranged also vertically but are reversed upside down. Accordingly, configuration of the passages for thin and thick gas mixtures in this apparatus 140 differs a little from those passages built in the foregoing apparatuses 1 and so on. However, the pattern of their flow routes is almost identical to those that have been described above. The fuel gas from the fuel nozzle 80 will enter in part the venturi 23 through its supplementary fuel-feeding openings 29, as shown at the arrows in FIG. 31. Inside this venturi 23 as a region of the thin gas passage 22, the part of fuel gas having entered it will be intermixed with the ambient air from the air intake 16, and then jetted from the main burner ports 53.

Figure 32:
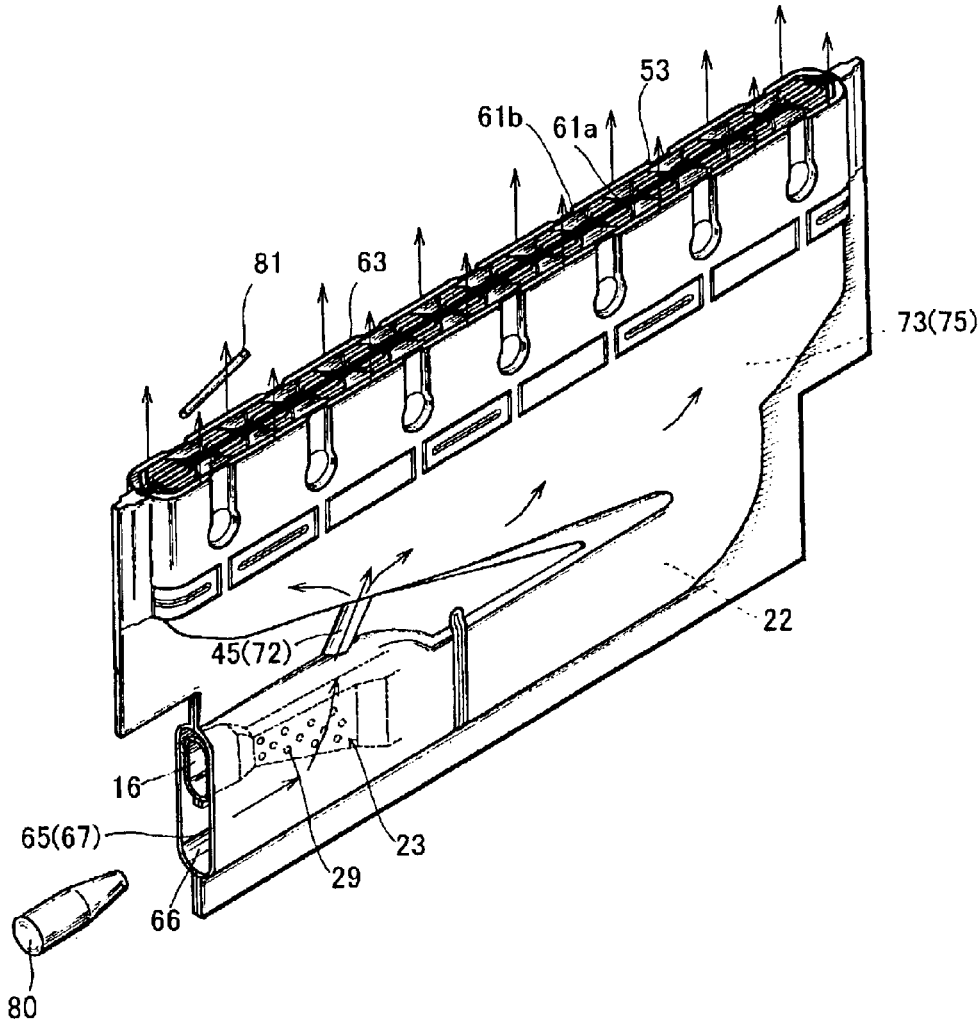
FIG. 32 likewise is a scheme of the flow of another fuel gas mixture being jetted from auxiliary burner ports that also are built in the apparatus shown in FIG. 29.

The other part of gas mixture having not been diverged into the thin gas passage 22 but having passed by the venturi 23 will advance upwards and forwards through the constricted canal 72 and enter the expanded canal 75, as shown in FIG. 32. A part, usually a major part, of the gas mixture thus having entered the thick gas passage 73 is blown out of the auxiliary burner ports 63 as in the foregoing apparatuses 1 and so on. The other part, usually a minor part, of this thick gas mixture having entered the said passage 73 will enter and be jetted off the collateral burner port 61*a* and 61*b*, also as in the foregoing apparatuses 1, etc. On the other hand, jetted from the intermediate burner ports 78 is an intermixture of the portion of thin gas (for main burner ports 53) and the portion of thick gas (for auxiliary burner ports 63). In this way, the main flames being generated at the main burner ports 53 in this apparatus 140 will be stabilized by the other fire flames.

Similarly to the foregoing apparatuses 1, etc., the thick gas passage 73 in this apparatus 140 has a region surrounding a part of the thin gas passage 22. Supplementary openings 29 are formed in this part of the latter passage 22 so that a part of fuel gas from the fuel intake 66 will enter it so as to be blended with ambient air from the air intake 66. Also in this apparatus 140, fuel concentration is controlled orderly to be constant for each of the gas mixtures fed to the burner ports 53, 61, 63 and 78, with the fire flames generated thereat being stabilized.

Figure 33:
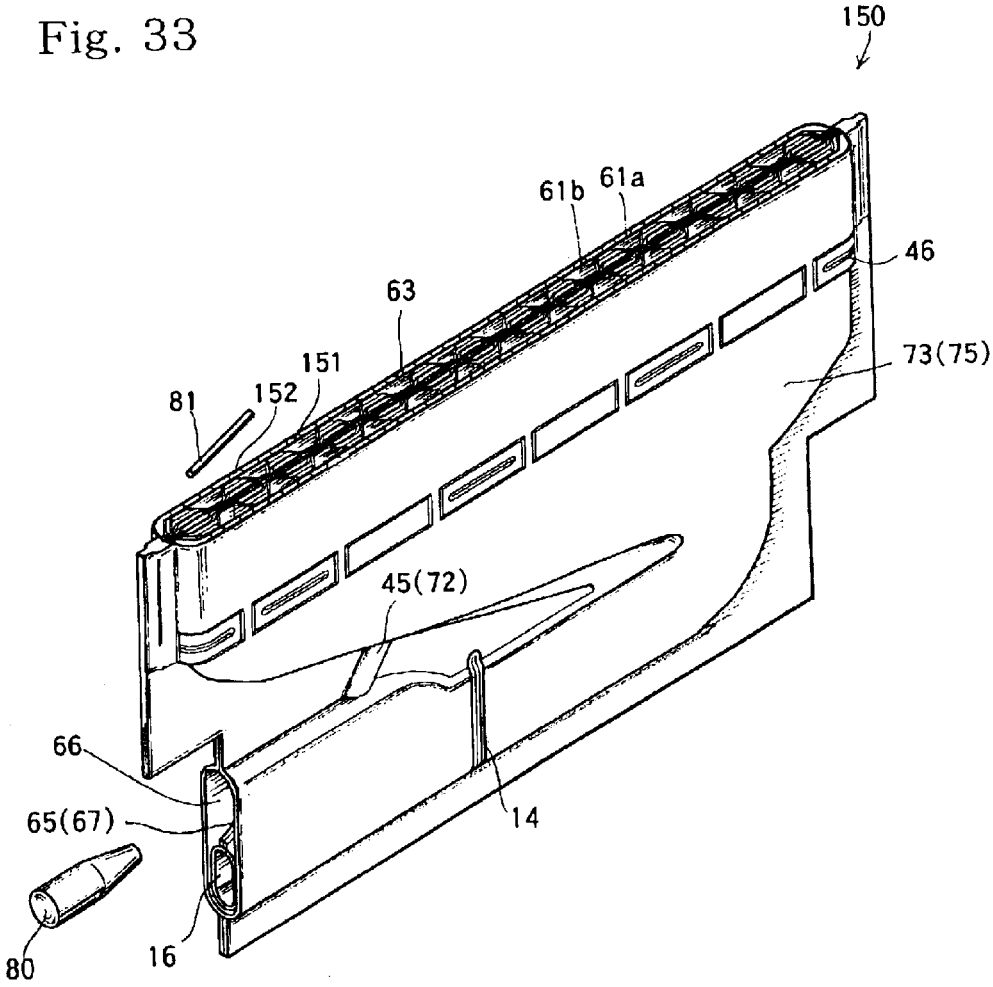
FIG. 33 is a perspective view of the combustion apparatus according to yet still another embodiment.
Figure 34:
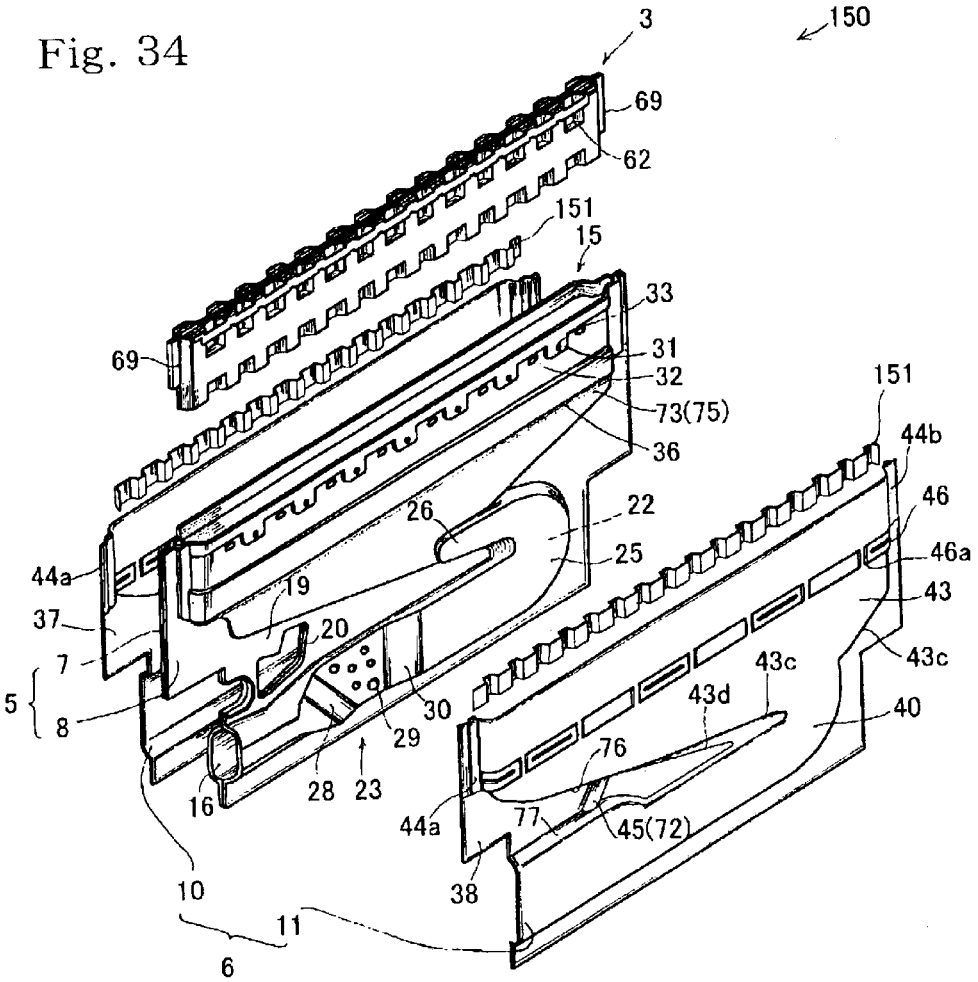
FIG. 34 is an exploded perspective view of the combustion apparatus shown in FIG. 33.

The combustion apparatus of the invention may be modified in a still another manner. For example, a further type of apparatus 150 shown in FIGS. 33 and 35 somewhat differs from the foregoing ones 1, etc. in respect of its auxiliary burner ports 63 and its burner body's supplementary part 6 forming these burner ports. Other structural elements of this combustion apparatus 150 are similar to those that have been described above. In detail, any round recesses 47*a* and any rectangular recesses 47*b* are not formed in plates 10 and 11 of this apparatus 150. Instead, a corrugated flame stabilizer 151 intervenes between the principal part 5 and each plate of the supplementary part 6. Thus, a space in which the auxiliary burner ports 63 are disposed in the foregoing embodiments and examples are now divided by the stabilizer 151 into a number of stabilizing burner ports 152 arranged in a zigzag pattern.

These stabilizing burner ports 152 are employed here in place of auxiliary burner ports 63, without fear of adversely affecting but rather raising the rigidity of this apparatus 150, thus enhancing durability and stability of its operation. The number of such stabilizing burner ports 152 may considerably be greater than that of auxiliary burner ports. They 152 can be arranged either at any constant pitch, or at varying intervals if so desired. In this manner, relatively smaller but much steadier unit auxiliary flames will be provided to further stabilize the main fire flames.

In summary, a region of the thick gas passage in this invention surrounds a section of the thin gas passage having supplementary fuel feeding openings formed in this section. A part of fuel gas thus transferring from the former passage into the latter one is mixed with air therein to produce a homogeneous gas mixture. This gas mixture flows to the main burner ports and generates thereat a well-stabilized main fire flame, remarkably reducing the amount of incomplete combustion byproducts.

It is noted that the blending station in the apparatus of the invention has a cross-sectional area gradually decreasing away from the fuel inlet and towards the downstream end of thick gas passage. Therefore, the fuel gas will be mixed well with air to produce a homogenous gas mixture to be directed to said downstream end. Ratio in fuel content of the thick gas mixture to the thin gas mixture will now remain constant, thereby avoiding any inhomogeneous mixing of the air with the fuel gas and preventing any uneven combustion from occurring in the main and auxiliary flames.

It also is noted that the blending station has a cross-sectional area tapered off at first towards the downstream end thereof and then increasing again away to be flared to expand itself, to thereby forming a throttle. In the tapered region of the station, a sufficient blending of the fuel gas with the sucked ambient air, whilst in the expanded region the mixture will become uniform in pressure. The thick gas mixture thus rendered homogenous in composition and uniform in pressure will further travel towards the arrays of burner ports, and on the other hand a minor part of this mixture will be intermixed with a part of thin gas at one of said burner port arrays.

It is noted further that the mixing-accelerator is incorporated in the blending station to facilitate the fuel gas to be blended quickly and smoothly with the air. The resultant homogeneous mixture will be fed mainly to the downstream regions of thick gas passage, and in part and later to the thin gas passage, also contributing to prevention of uneven combustion due to any insufficient degree of mixing.

It is noted still further that the branching station is disposed downstreamly of the throttle of said blending station, so that a part of the well homogenized thick gas mixture will be diverged at this branching station into the thin gas passage. Thus, ratio in fuel concentration of the thick gas (towards the main burner ports) to the thin gas (towards the auxiliary burner ports) is stabilized such that any uneven combustion occurs neither in main fire flames nor in auxiliary flames.

It is to be noted that the convex or concave portions, such as relatively small lugs or recesses, are preferably formed in the inner periphery of the thin and/or thick gas passages. Said portions are effective to prevent any huge eddies or any unpleasant noise from being produced or emitted when the air or fuel gas flows, and also to render more uniform the gas mixtures in their internal pressure distribution before delivered to downstream regions of their passages.

It also is to be noted that the constricted canal preferably disposed dowstreamly of the blending station and upstreamly of the burner port assembly does contribute to further mixing of fuel gas with air, prior to arrival at this assembly. Thus, an extremely homogeneous gas mixture is fed to the auxiliary burner ports to give very stable fire flames.

Preferably, the direction of said constricted canal or a jet therefrom does intersect with the center of expanded canal of thick gas passage, so that the auxiliary burner ports can quickly form stable auxiliary flames all over their length. Inflammability and stability of main flames of the thin gas jetted from the main burner ports are now improved, remarkably reducing exhaust of incompletely combusted fuel gas.

In an also preferable example, two metal plates to form between them regions of the gas mixture passage are pressed and forced into an interference-fit engagement with each other, whereby leakage of any of the gas mixtures and an intermixing thereof are prevented so that concentration and jet rate of each gas mixture is made uniform to stabilize combustion.

What is claimed is:

1. A combustion apparatus comprising:

at least one main burner port for jetting and burning a thin mixture of a fuel gas;

at least one auxiliary burner port for jetting and burning a thick mixture of the fuel gas that is thicker therein than in the thin mixture;

an air intake for introduction of air or the thin gas mixture;

a fuel intake for introduction of the air and the thick gas mixture;

a thin gas passage for supplying the main burner port with the thin gas mixture;

a thick gas passage for supplying the auxiliary burner port with the thick gas mixture;

the air intake communicating with the thin gas passage; and the fuel intake communicating with the thick gas passage, wherein the thick gas passage surrounds in part a portion of the thin gas passage, and the portion of this passage has at least one supplementary gas opening formed therein, so that an amount of the thick gas mixture flowing through the thick gas passage will enter the thin gas passage through the supplementary gas openings.

2. A combustion apparatus as defined in claim 1, further comprising a blending station formed by reducing the cross-sectional area of the thick gas passage gradually towards its downstream end from the fuel intake for blending the thick gas and air.

3. A combustion apparatus as defined in claim 1, further comprising a blending station formed by reducing the cross-sectional area of the thick gas passage gradually towards its downstream end from the fuel intake, and still further comprising a branching station for directing a part of the thick gas mixture to the thin gas passage, with the branching station being disposed downstream of a neck where the blending station has a minimum cross-sectional area.

4. A combustion apparatus as defined in claim 1, further comprising a blending station formed by reducing the cross-sectional area of the thick gas passage gradually towards its downstream end, and further comprising a means for accelerating the mixing of the air with the fuel gas from the fuel intake, the means being disposed in the blending station.

5. A combustion apparatus as defined in claim 1, further comprising convex or concave portions formed in part of or all over the inner surface of the thin and/or thick gas passages.

6. A combustion apparatus as defined in claim 1, wherein the thick gas passage comprises an expanded section communicating with the auxiliary burner port, as well as a constricted section opened towards the expanded section so as to feed thereto the thick gas mixture.

7. A combustion apparatus as defined in claim 1, wherein the thick gas passage comprises an expanded section communicating with the auxiliary burner port, as well as a constricted section opened towards the expanded section so as to feed thereto the thick gas mixture, and the expanded section spreads in a plane and has an end opened outwards so as to comprise an elongated region having a cross section extending in parallel with another plane that includes the open ends of burner ports, and wherein an opening of the constricted section communicates with the interior of the expanded section, and is offset from the center of an imaginary line along which the expanded section extends, so that the opening of said constricted section, and/or the direction of jetting the gas mixture therefrom, faces the center of said imaginary line.

8. A combustion apparatus as defined in claim 1, wherein two or more plates are laid one on another such that convex or concave portions of these plates form cavities, with further portions of the plates being pressed together to provide airtight seals such that the cavities continue from and communicate with each other to form passages for air and fuel gas, and wherein some of the further portions that are of convex or concave shapes in the same direction are pressed together to undergo plastic deformation so as to form interference-fit engagements serving as the most air-tight seals.

9. A combustion apparatus comprising:

at least one main burner port for jetting and burning a thin mixture of a fuel gas;

at least one auxiliary burner port disposed adjacent to the main burner port so as to jet and burn a thick mixture of the fuel gas that is thicker therein than in the thin mixture;

an air intake for introduction of air or the thin gas mixture;

a fuel intake for introduction of the air and the thick gas mixture;

a thin gas passage connected to both the air intake and the main burner port in fluid communication therewith, so as to supply the main burner port with the gas mixture;

a thick gas passage connected to both the fuel intake and the auxiliary burner port in fluid communication therewith, so as to supply the auxiliary burner port with the gas mixture;

a blending station for intermixing the air with the thick gas mixture delivered from the fuel intake;

the thick gas passage having an expanded section and a constricted section, with the expanded section supplying the auxiliary burner port with the thick gas mixture; and the constricted section intervening between the blending station and the expanded section, whereby a part of the thick gas mixture flows from the blending station into the thin gas passage in order to form the thin gas mixture blown out through the main burner port, with the remainder of the thick gas mixture passing through the blending station and the constricted section so as to remain thick until blown out of the auxiliary burner port.

10. A combustion apparatus as defined in claim 9, wherein the blending station is formed by reducing the cross-sectional area of the thick gas passage gradually towards its downstream end from the fuel intake.

11. A combustion apparatus as defined in claim 9, further comprising a branching station for directing the part of thick gas mixture to the thin gas passage disposed downstreamly of a neck where the blending station has a minimum cross-sectional area.

12. A combustion apparatus as defined in claim 9, further comprising a means for accelerating the mixing of the fuel gas with the air.

13. A combustion apparatus as defined in claim 9, further comprising convex or concave portions formed in part of or all over the inner surface of the thin and/or thick gas passages.

14. A combustion apparatus as defined in claim 9, wherein the thick gas passage comprises an expanded section communicating with the auxiliary burner ports, as well as a constricted section opened towards the expanded section so as to feed thereto the air-fuel mixture, and the expanded section spreads in a plane and has an end opened outwards so as to comprise an elongated region having a cross section extending in parallel with another plane that includes the open ends of burner ports, and wherein an opening of the constricted section communicates with the interior of the expanded section, and is offset from the center of an imaginary line along which the expanded section extends, so that the opening of said constricted section, and/or the direction of jetting the gas mixture therefrom, faces the center of said imaginary line.

15. A combustion apparatus as defined in claim 9, wherein two or more plates are laid one on another such that convex or concave portions of these plates form cavities, with further portions of the plates being pressed together to provide airtight seals such that the cavities continue from and communicate with each other to form passages for air and fuel gas, and wherein some of the further portions that are of convex or concave shapes in the same direction are pressed together to undergo plastic deformation so as to form interference-fit engagements serving as the most air-tight seals.

16. A combustion apparatus comprising:

at least one main burner port for jetting and burning a thin mixture of a fuel gas;

at least one auxiliary burner port for jetting and burning a thick mixture of the fuel gas that is thicker therein than in the thin mixture;

an air intake for introduction of air or the thin gas mixture;

a fuel intake for introduction of the air and the thick gas mixture;

a thin gas passage connected to both the air intake and the main burner port in fluid communication therewith so as to supply the main burner port with the gas, the thin gas passage having at least one supplementary gas opening formed therein;

a thick gas passage connected to both the fuel intake and the auxiliary burner port in fluid communication therewith, so as to supply the auxiliary burner port with the gas mixture;

a blending station for intermixing the air with the thick gas mixture delivered from the fuel intake, formed by reducing the cross-sectional area of the thick gas passage gradually towards its downstream end from the fuel intake; and a branching station for directing a part of thick gas mixture to the thin gas passage, whereby a part of the thick gas mixture flows from the blending station through the supplementary gas openings and into the thin gas passage in order to form the thin gas mixture blown out through the main burner port, with the remainder of the thick gas mixture passing through the blending station so as to remain thick until blown out of the auxiliary burner port.

17. A combustion apparatus as defined in claim 16, wherein the blending station is formed by reducing the cross-sectional area of the thick gas passage gradually towards its downstream end from the fuel intake.

18. A combustion apparatus as defined in claim 16, further comprising a means for accelerating the mixing of the fuel gas with the air while the mixture thereof is flowing.

19. A combustion apparatus as defined in claim 16, further comprising convex or concave portions formed in part of or all over the inner surface of the thin and/or thick gas passages.

20. A combustion apparatus as defined in claim 16, wherein the thick gas passage has an expanded section and a constricted section, with the former section supplying the auxiliary burner port with the thick gas mixture, and the constricted section intervening between the blending station and the expanded section.

21. A combustion apparatus as defined in claim 16, wherein the thick gas passage comprises an expanded section communicating with the auxiliary burner ports, as well as a constricted section opened towards the expanded section so as to feed thereto the gas mixture, and the expanded section spreads in a plane and has an end opened outwards so as to comprise an elongated region having a cross section extending in parallel with another plane that includes the open ends of burner ports, and wherein an opening of the constricted section communicates with the interior of the enlarged section, and is offset from the center of an imaginary line along which the expanded section extends, so that the opening of said constricted section, and/or the direction of jetting the gas mixture therefrom, faces the center of said imaginary line.

22. A combustion apparatus as defined in claim 16, wherein two or more plates are laid one on another such that one convex or concave portions of these plates form cavities, with further portions of the plates being pressed together to provide airtight seals such that the cavities continue from and communicate with each other to form passages for air and fuel gas, and wherein some of the further portions that are of convex or concave shapes in the same direction are pressed together to undergo plastic deformation so as to form interference-fit engagements serving as the most airtight seals.

* * * * *